US011486640B2

(12) United States Patent
Thompson et al.

(10) Patent No.: US 11,486,640 B2
(45) **Date of Patent: *Nov. 1, 2022**

(54) APPARATUS AND METHOD FOR DEVELOPING FREEZE DRYING PROTOCOLS USING SMALL BATCHES OF PRODUCT

(71) Applicant: Millrock Technology, Inc., Kingston, NY (US)

(72) Inventors: T. N. Thompson, Kingston, NY (US); Qiming Wang, Kingston, NY (US); Richard Martino, Saugerties, NY (US); Weijia Ling, Shanghai (CN)

(73) Assignee: MILLROCK TECHNOLOGY, INC., Kingston, NY (US)

( * ) Notice: Subject to any disclaimer, the term of this patent is extended or adjusted under 35 U.S.C. 154(b) by 586 days.

This patent is subject to a terminal disclaimer.

(21) Appl. No.: 16/400,045

(22) Filed: May 1, 2019

(65) Prior Publication Data

US 2019/0285342 A1 Sep. 19, 2019

Related U.S. Application Data

(63) Continuation of application No. 15/228,100, filed on Aug. 4, 2016, now Pat. No. 10,605,527.
(Continued)

(51) Int. Cl.
*F26B 5/06* (2006.01)
*F26B 9/06* (2006.01)
(Continued)

(52) U.S. Cl.
CPC ..... *F26B 5/06* (2013.01); *F26B 3/20* (2013.01); *F26B 9/066* (2013.01); *F26B 21/10* (2013.01)

(58) Field of Classification Search
CPC .... F26B 5/06; F26B 3/20; F26B 21/10; F26B 9/066; G01K 17/00
See application file for complete search history.

(56) References Cited

U.S. PATENT DOCUMENTS 3,199,217 A 8/1965 Oldenkamp
3,685,163 A 8/1972 Olt
(Continued)

FOREIGN PATENT DOCUMENTS

CA 2 282 866 3/2000
CN 203758626 8/2014
(Continued)

OTHER PUBLICATIONS

Schneid et al. (Investigation of Novel Process Analytical Technology (PAT) Tools for Use in Freeze-Drying Processes, 2009); (Year: 2009).*
(Continued)

*Primary Examiner* — Jessica Yuen
(74) *Attorney, Agent, or Firm* — Nixon & Vanderhye, P.C.

(57) ABSTRACT

A method of monitoring and controlling a freeze drying process in a freeze drying apparatus having walls, shelves and a number of vials or trays positioned on different areas of the shelves and containing product to be freeze dried. One or more vials or trays are selected that are representative of the positions of all of the vials or trays in different areas of the shelves. One or more heat flux sensors are positioned between the selected vials or trays and adjacent portions of the walls and/or shelves. The heat transfer between the selected vials or trays and the adjacent wall or shelf portions is measured during the freezing and drying stages of the freeze drying process.

24 Claims, 17 Drawing Sheets

Related U.S. Application Data

(60) Provisional application No. 62/222,136, filed on Sep. 22, 2015, provisional application No. 62/279,564, filed on Jan. 15, 2016.

(51) Int. Cl.
*F26B 3/20* (2006.01)
*F26B 21/10* (2006.01)

(56) References Cited

U.S. PATENT DOCUMENTS

| | | | | |
|---|---|---|---|---|
| 3,961,424 | A | 6/1976 | Elerath | |
| 4,780,964 | A | 11/1988 | Thompson | |
| 5,090,132 | A | 2/1992 | Kobayashi | |
| 5,217,210 | A | 6/1993 | Schutzner | |
| 5,280,678 | A | 1/1994 | Jennings | |
| 5,367,786 | A | 11/1994 | Jennings | |
| 5,398,426 | A | 3/1995 | Connor | |
| 5,428,905 | A | 7/1995 | Beurel et al. | |
| 5,689,895 | A | 11/1997 | Sutherland et al. | |
| 6,163,979 | A | 12/2000 | Oetjen et al. | |
| 6,176,121 | B1 | 1/2001 | Oetjen et al. | |
| 6,643,950 | B2 | 11/2003 | Lambert et al. | |
| 6,971,187 | B1 | 12/2005 | Pikal et al. | |
| 8,117,005 | B2 | 2/2012 | Barresi et al. | |
| 8,121,637 | B2 | 2/2012 | Zhao | |
| 8,240,065 | B2 | 8/2012 | Rampersad et al. | |
| 8,434,240 | B2 | 5/2013 | Thompson | |
| 8,516,714 | B2 | 8/2013 | Biemans et al. | |
| 8,769,841 | B2 | 7/2014 | Gruber | |
| 8,793,895 | B2 | 8/2014 | Gasteyer et al. | |
| 8,793,896 | B2 | 8/2014 | Patel et al. | |
| 8,919,007 | B2 | 12/2014 | Friess et al. | |
| 8,966,782 | B2 | 3/2015 | Kuu et al. | |
| 9,121,637 | B2 * | 9/2015 | Ling | F26B 5/06 |
| 2004/0060191 | A1 | 4/2004 | Sennhenn | |
| 2004/0250441 | A1 | 12/2004 | Haseley et al. | |
| 2006/0053652 | A1 | 3/2006 | Gyory et al. | |
| 2008/0060379 | A1 | 3/2008 | Cheng | |
| 2008/0098614 | A1 | 5/2008 | Tchessalov et al. | |
| 2009/0276179 | A1 | 11/2009 | Barresi et al. | |
| 2010/0107436 | A1 | 5/2010 | Velardi et al. | |
| 2011/0247234 | A1 | 10/2011 | Friess et al. | |
| 2012/0077971 | A1 | 3/2012 | Kuu | |
| 2012/0192447 | A1 | 8/2012 | Thompson et al. | |
| 2012/0272544 | A1 | 11/2012 | Ling | |
| 2014/0026434 | A1 | 1/2014 | Sawada et al. | |
| 2014/0041250 | A1 | 2/2014 | Ling | |
| 2014/0202025 | A1 | 7/2014 | Ling | |
| 2014/0373382 | A1 | 12/2014 | Ling | |
| 2015/0040420 | A1 | 2/2015 | Ling | |
| 2017/0082361 | A1 | 3/2017 | Thompson et al. | |

FOREIGN PATENT DOCUMENTS

| | | |
|---|---|---|
| DE | 3260464 | 8/1984 |
| GB | 1 221 502 | 2/1971 |
| JP | 2-169984 | 6/1990 |
| JP | 2010-144966 | 7/2010 |
| JP | 2014-214992 | 11/2014 |
| WO | 2007/079292 | 7/2007 |

OTHER PUBLICATIONS

Chen et al. ( Comparative Rats of Freeze-Drying for lactose and sucrose Solution as Measured by Photographic Recording, Product Temperature, and Heat Flux Transducer, 2008) (Year: 2008).*

Fissore (A model-based approach for recipe design and scale-up of freeze-drying processes, 2012) (Year: 2012).*

Siew (Controlling Ice Nucleation During the Freezing Step of Lyophilisation) (Year: 2013).*

Guide to Meteorological Instruments and Methods of Observation 2008 (Year: 2008).*

Obeidat, et al. "Development of a Mini-Freeze Dryer for Material-Sparing Laboratory Processing with Representative Product Temperature History" AAPS PharmSciTech (# 2017) DOI: 10.1208/S12249-017-0871-5, Sep. 2017 (11 pages).

Goldman et al., "Heat Transfer Adjustment in a Scale-Down 7-Vial Micro Freeze Dryer for At-Scale Lyophilization Cycle Development and Optimization" Bristol-Myers Squibb Company, Princeton University, Oct. 2017 (1 page).

Extended European Search Report dated Jun. 5, 2019 issued in EP No. 16 84 9366 (10 pages).

Kuu, et al. "Modeling of Heat and Mass Transfer Processes for the Gap-Lyophilization System Using the Mannitol-Trehalose-NaCl Formulation", Research Article—Pharmaceutics, Drug Delivery and Pharmaceutical Technology, Mar. 19, 2014 (13 pages).

Genesis—Brochure: (Jun. 26, 2012) https://web.archive.org/web/20120526014309/http://www.spscientific.com:80/PDFs/Products/Freeze-Dryers--Lyophilizers/Floor-Model-Tray-Pilot-Lyophilizers/Genesis/Genesis---Brochure.pdf (4 pages).

Obeidat, et al. "Development of a Mini-Freeze Dryer for Material-Sparing Laboratory Processing with Representative Product Temperature History" AAPS PharmSciTech (# 2017) DOI: 10.1208/s12249-017-0871-5, published Sep. 13, 2017 (11 pages).

Geiseler, et al. "The importance of being small: miniaturisation of freeze drying Equipment", European Pharmaceutical Review, Aug. 18, 2017 (11 pages).

Author unknown, "LyoCapsule™ Freeze Dryer", Pharmaceutical online, Jul. 17, 2017 (1 page).

T.N. Thompson, LyoPAT™: "Real-Time Monitoring and Control of the Freezing and Primary Drying stages During Freeze-drying for Improved Product Quality and Reduced Cycle Times" American Pharmaceutical Review Fresh Perspectives, Nov./Dec. 2013 (7 pages).

* cited by examiner

19 Vial Nest – Edge vs Center Vials
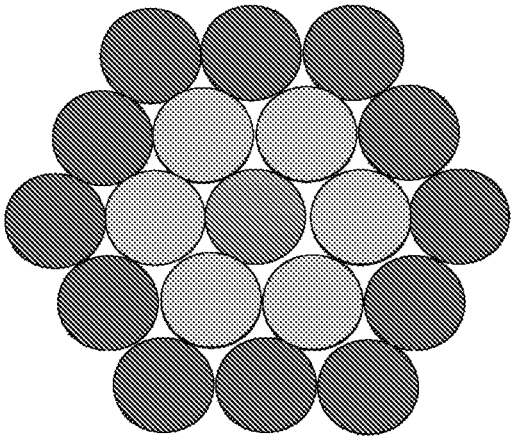
Expected Drying Pattern
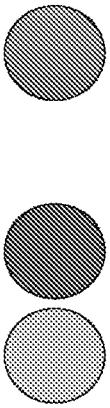
Figure 2

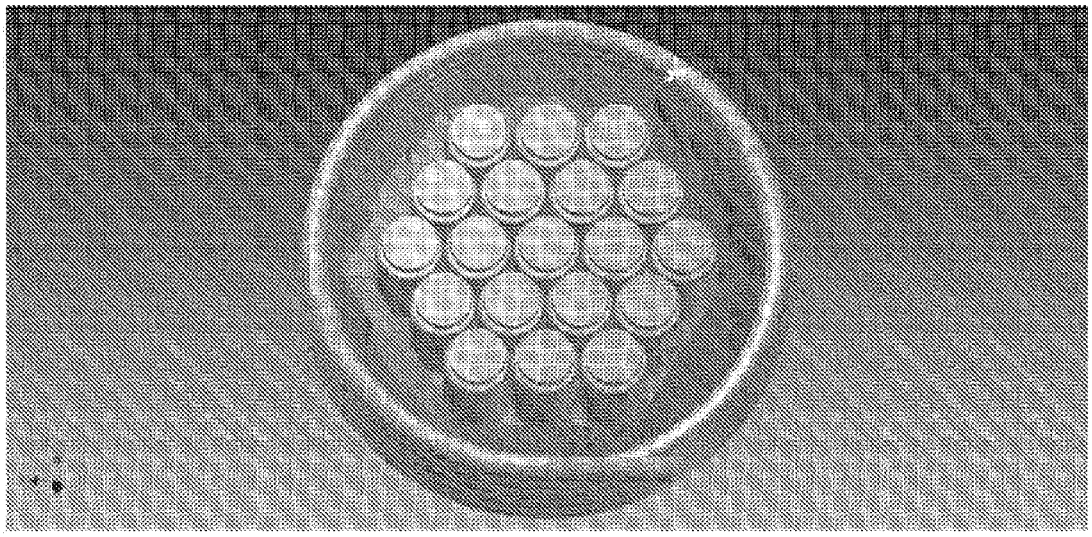
Figure 7 – One alternate concept of emulator assembly
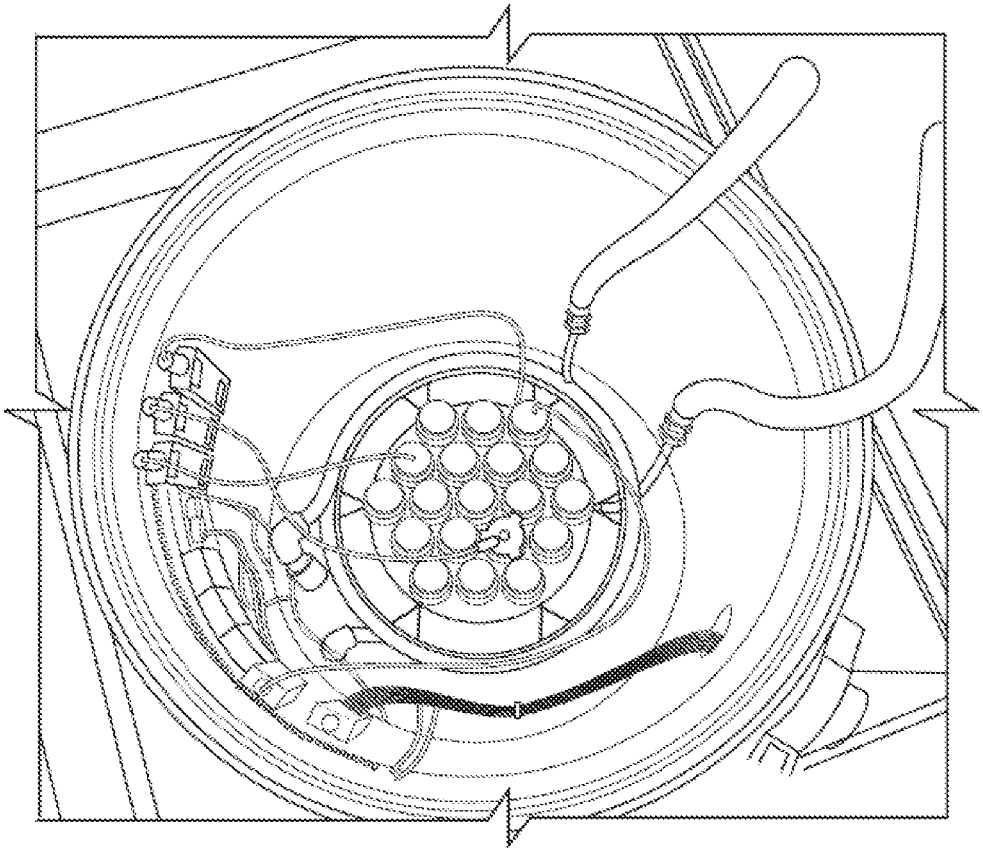
FIG. 8
Thermal emulator Apparatus on any freeze dryer shelf – Top View Apparatus Example with Flexible Membranes

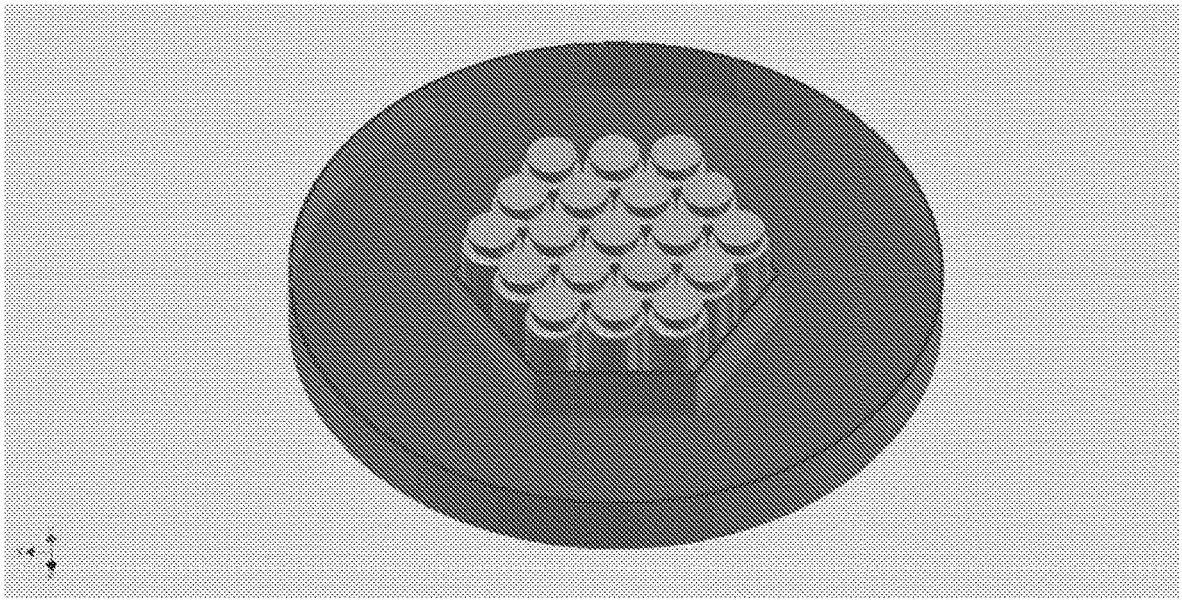
Figure 15 – a circulator fluid filled vessel around a 19 vial nest
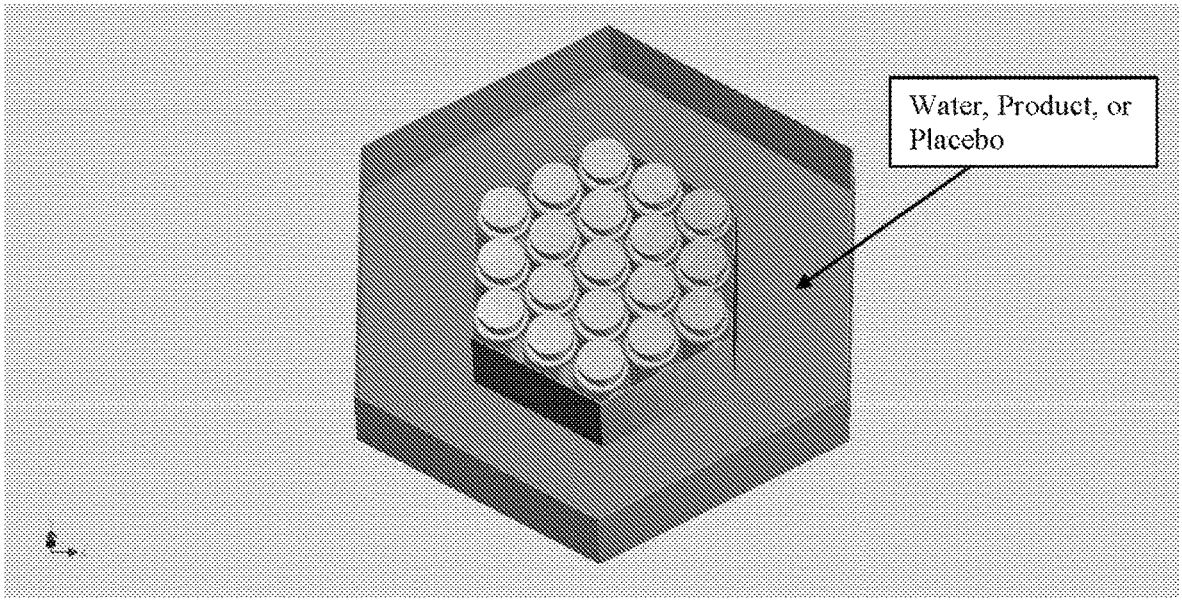
Figure 16 – a hexagonal fluid filled vessel around a 19 vial nest

APPARATUS AND METHOD FOR DEVELOPING FREEZE DRYING PROTOCOLS USING SMALL BATCHES OF PRODUCT

CROSS REFERENCES TO RELATED APPLICATIONS

This application is a Continuation of U.S. patent application Ser. No. 15/228,100 filed Aug. 4, 2016, which claims the priority of Provisional Patent Applications No. 62/222,136 filed on Sep. 22, 2015 and No. 62/279,564 filed on Jan. 15, 2016, the entire contents of each of which are hereby incorporated by reference. The entire contents of U.S. Pat. Nos. 8,875,413 and 9,121,637 are incorporated by reference herein.

BACKGROUND AND BRIEF SUMMARY OF THE TECHNOLOGY

1. Field of the Technology

The present device relates to apparatus and methods for use in controlling the temperature of edge vials in a freeze drying process to enable analysis, development, and optimization of freeze drying protocols with a minimum amount of sample required to develop such protocols.

2. Background and Brief Summary

Traditionally only temperature is measured from various points of a system to monitor and control the freeze drying process. However, knowing temperature alone is not enough to control and optimize the freeze drying process, since temperature change is the end result of a heat transfer event. In most cases, the moment an undesirable temperature change is detected, it is too late to make any correction to fix it.

Traditional freeze drying process control is inefficient open loop control due to limited feedback from product temperature and only being able to control the heat transfer fluid temperature from the point at which it flows into the shelf stack. Depending on the different product loads (i.e., quantity, size and fill of product or vials) as well as the equipment construction (i.e., shelf construction, fluid pump size and flow rate, etc.) the actual shelf surface temperature varies, although the inlet fluid temperature remains constant. In addition, the heat transfer coefficient changes with vacuum level and product container. This means that the same inlet shelf temperature may result in different product temperatures and therefore different freezing and drying results. The missing link in this control loop is heat flux measurement between shelf and product.

Freezing Step

Freezing, in the freeze drying process, consists of a nucleation process and a post nucleation thermal treatment to produce an ice crystal structure that concentrates the previously dissolved product into a fixed matrix between the ice crystals. Typically, nucleation occurs in a random fashion due to differences in heat transfer resulting in inconsistent crystallization across a batch which results in different drying performance and inconsistent product results. Proper crystal structure allows an elegant cake to be produced which also reduces the total drying time. To produce a consistent crystal structure that aids drying, controlled nucleation is combined with a proper thermal treatment.

Temperature sensors do not provide the feedback required for consistent crystallization process control. For example, during freezing the product may not change temperature, such as during removing latent heat in the freezing step. Although the product temperature doesn't change, there is a significant heat transfer event taking place.

During post nucleation latent heat removal, the speed of heat transfer has a major impact on ice crystal size, orientation and distribution. The ice crystal structure dramatically influences the drying performance and final product appearance. Measuring the heat flow enables better control of the freezing process. This method enables control of the shelf temperature during thermal events when there is no product temperature change.

Drying Step

Drying can be further divided into primary drying and secondary drying steps. Primary drying is a sublimation process where ice in a frozen product turns directly into vapor which is then condensed on a cold condensing surface leaving behind a matrix of concentrated product in the vial or tray on the shelf. Secondary drying is a desorption process. The remaining moisture in the concentrated product matrix is reduced to a level that is best for product long term stability.

Typically, optimized drying requires a process to efficiently remove water without losing the product matrix structure created during the freezing step. The key here is keeping the product at the maximum allowed temperature while still below the critical temperature. The critical temperature is the product temperature above which the product melts and/or the matrix collapses.

There may also be applications when some form of collapse is required. The process can also be monitored, optimized and controlled for these applications.

From a process control perspective, cycle optimization results in a shelf temperature and chamber pressure combination that balances the heat and mass flow and maintains the product at its optimum temperature. Traditionally this is a very challenging task which involves a multi-step trial and error approach, since measuring temperature and pressure alone cannot solve the heat and mass flow balance problem.

Some methods that are currently used for in-process measurement in freeze drying systems are:

MTM—An in-process technique that only calculates the product temperature based on pressure rise measurements. This technique is limited to critical batch sizes and does not provide mass flow information. It can only provide intermittent measurement no faster than every half hour. Measurements are limited to the first half of a cycle as it loses its accuracy in the second half of the cycle.

TDLAS—Tunable Diode Laser—An in-process technique that measures mass-flow through a duct using a laser. This is an expensive technique that works only during the drying stage of the freeze drying process. Only equipment with an external condenser can be fitted with TDLAS. The instrument itself significantly extends the length of the vapor duct and limits the maximum vapor flow rate through the duct to the condenser.

Two container differential heat flux measurement—described in U.S. Pat. No. 5,367,786 is a heat flux based process control method which measures the difference in heat flux between a process monitoring container and a reference container on a single heating or cooling surface. Since no two containers are identical, especially glass vials used in the apparatus, there is a limit to the accuracy of the measurement. Placement of an empty reference container among the sublimating product containers significantly changes the heat transfer mechanism on both measuring and referencing points. As heat transfer can happen between an empty reference container and product containers, measuring accuracy of the differential heat flux can be compromised. Placing a metal foil based radiant shield between two containers further changes the heat transfer mechanism between heating or cooling surfaces. The fundamental limitation of this method is that it significantly changes the heat transfer mechanism, which the method is trying to measure. In a production scale system, placement of the measuring apparatus is impractical. It also requires a temperature probe being directly placed in a product container which is considered invasive. In view of the above limitations, this method has never been widely adopted in either lab or production applications.

Crystal structure may very well be the most important physical property to control in the freeze drying process. However, most of the concentration on improving the freeze drying process has centered on the sublimation or primary drying phase. Since the sublimation process is the longest step in freeze drying, improvements can result in higher output and better product consistency.

Placing vials on a shelf and lowering the shelf temperature, as is done in the majority of freeze dryers, results in non-homogeneous freezing of the product in the vials due to different degrees of super-cooling. The result is varying crystal structures across the vials caused by different nucleation temperatures and rates. The variation in crystal structure results in varying sublimation rates and therefore product inconsistencies.

Primary drying is the longest step of the freeze drying process. Most of the effort for process improvement has focused on measuring and controlling the product temperature as close to its critical point as possible to shorten the cycle. However, without proper ice structures in the frozen product there is a limit to how much faster cycles can be performed without compromising end product quality. Producing a better product crystal structure, through proper freezing, can result in both higher yields due to more uniform cake structure and shorter primary drying cycles due to reduced cake resistance. In general, larger crystals are easier to freeze dry, while small crystals impede sublimation thus lengthening the process. The speed of freezing has a direct effect on the size and type of crystal. Faster freezing produces a smaller crystal, while slower freezing produces are larger crystal. Changes in freezing rate result in varying crystal structures.

The challenge to creating a proper crystal structure is that the typical freezing process does not control the heat flow to the product and therefore crystal growth varies. Placing vials on a shelf and lowering the shelf temperature, as is done in the majority of freeze dryers, results in heterogeneous nucleation across the batch and heterogeneous crystal growth in the vials. The randomness of freezing is due to different degrees of super-cooling and variations in heat flow during the ice crystal growth process. It is important to understand that the rate of crystal growth varies even though the rate of shelf temperature change may not.

The main challenge during this stage of freezing is that nucleation is random and product temperature change does not occur during the phase change of free water from liquid to solid. The rate of crystal growth is dependent on the heat transfer efficiency of the equipment. The heat flow changes significantly as the shelf is cooled and the product freezes. The changing heat flow results in an inconsistent ice structure inside the vial and across the batch.

In order to create the most consistent crystal structure in the vial and across the batch a common starting point and a method for controlling the rate of crystal growth is required. To improve on the current process of freezing, a method for controlled nucleation combined with a method for monitoring and controlling the heat flow during crystallization is required. Producing a controlled nucleation event provides a consistent starting point across the batch for freezing, while controlling the heat flow during crystal formation enables growth of more ideal ice structures. The goal for nucleation is to have all of the vials nucleate at the same time, same temperature and at the same rate. The result will be a consistent starting point across the batch for controlling crystal growth during crystal formation inside the vial.

It is important to point out, that controlled nucleation by itself does not significantly reduce primary drying times. Controlled nucleation provides a homogeneous starting point, but it is proper control of super-cooling and control of post-nucleation crystal growth that can produce a reduction in primary drying time. For example, sucrose super-cooled to −10C, nucleated, and then cooled rapidly will result in a small crystal structure and minimal improvement in primary drying times. Therefore, post-nucleation thermal treatment is critical to a uniform and freeze drying friendly ice structure inside the vial.

Problem related to "edge vial effect": During the primary drying phase of a freeze drying process, edge vials, those which are not surrounded by 6 other vials, will sublimate faster than centers vials, those vials which are surrounded by 6 other vials. The 'edge vial effect' creates two problems:

a. First, in large batches the non-uniformity of edge vials during primary drying result in lower process yields, increased drying times to keep the edge vials below their critical temperature, and inconsistent product quality.
b. Second, when attempting to freeze dry a small batch of product there is a greater percentage of edge vials and the small batch dries significantly faster than a large batch. The result is that a small batch cannot be used to develop freeze drying protocols. Using large batches costs more in product, time, and resources.

The need for an apparatus to eliminate the 'edge vial effect' is apparent.

A solution to this problem would have benefits which include but are not limited to:

a. First, in large batches the non-uniformity of primary drying would be eliminated resulting in better yields and more consistent quality and shorter primary drying times.
b. Second, an apparatus would enable a method to use a small batch of product for analyzing and developing freeze drying protocols. This will save significant time, money and resources for the user.

Overview—The freeze drying process is a dynamic heat and mass transfer process that is typically controlled by adjusting the shelf temperature at a given vacuum level over a period of time. The shelf temperature profile is a sequence of discrete steps for the three main processes; freezing, primary drying and secondary drying.

A freeze drying recipe, protocol, or profile that works on one freeze dryer may not work on other freeze dryers due to differences in the heat transfer dynamics inherent to each. Therefore, developing a protocol that can be easily transferred between freeze dryers often requires extensive testing and each profile may need to be modified many times to produce the same, or at least similar, process results.

Currently, the development of freeze drying protocols is done in a rudimentary manner, using a significant amount of product in a larger than necessary freeze dryer, with multiple runs being performed to gather the required data. This iterative process is time intensive and requires an ample amount of product, which can be expensive. A sufficient amount of product may not be available to use this method of protocol development.

The freeze drying process has two major steps: freezing and drying. Each step involves a different heat transfer dynamic between the shelf of the freeze dryer and the product, depending on the number of vials containing the product and the characteristics of the freeze dryer. Freezing is a cooling process with the heat transfer from the product to the shelf at atmospheric pressure. Drying is a heating process wherein heat is added from the shelf to the product while under a vacuum which causes the ice to sublimate.

The heat transfer dynamics of freeze drying are directly affected by the type and quantity of vials and the freeze drying equipment. Creating the right freezing process and primary drying process is critical to developing a robust and efficient freeze drying cycle. It is well understood that a small nest of, for example 1 to 37, vials will freeze faster and sublimate much faster than a full shelf of vials (typically containing 100 to 2000 vials) when processed with the same freeze drying protocol. Larger batches of vials dry more slowly due to reduced radiation effects and cooling from inter-vial heat transfer dynamics. Smaller batches of product have a larger radiation heat transfer component and have a minimal inter-vial cooling effect allowing more of the energy to be transferred into the sublimation process which reduces the drying time and produces different final product results. This has made the creation of freeze drying protocol development with a small batch of vials extremely difficult and mostly impractical up to this point in time.

The concept for developing protocols is to establish meaningful freezing and primary drying profiles in a Source Freeze Dryer ("SFD") using a small batch that is intended to mimic the characteristics and conditions of larger batches that are used in production, which is the Target Freeze Dryer ("TFD"). While mimicking the TFD as closely as possible, critical process parameters can be monitored and/or controlled, and used to develop a transferrable freeze drying protocol.

Freezing—Proper freezing is required to improve the sublimation process and to protect the product. Achieving the proper size and consistency of the ice crystals are critical to creating good product. Larger ice crystals as well as intra-vial consistency enables more efficient primary drying. Some products may also exhibit unwanted changes in pH, precipitation, or phase separation if not properly frozen.

Freezing, in the freeze drying process occurs in several discrete steps. The process consists of super-cooling the liquid, nucleation where 3-19% of the water is crystalized, the growth of the ice crystal structure in the minimal freeze concentrate until all the water is frozen and finally the solidification of the maximal freeze concentrate to a temperature below the glass transition temperature. Proper crystal structure, which typically comprises high porosity, enables more efficient primary drying and helps produce a visually appealing cake and may aid in reducing reconstitution time. At times an annealing step, which involves holding the product at a temperature above the final freezing temperature for a certain period of time, may be added to encourage crystallization of the excipients and to allow the ice crystals to increase in size prior to primary drying.

Nucleation—In typical applications, a freezing protocol is used which reduces the shelf temperature at a specified rate and holds the shelf temperature for a period of time to ensure the product is frozen and stable. When cooling the shelves at a programmed rate, nucleation occurs in an undesirably random fashion resulting in inconsistent crystallization across a batch which results in extended primary drying times and inconsistent product results.

During the freezing process energy is removed from the vials by cooling the shelf surface. The product temperature cools below its freezing point (super-cools) until there is a nucleation event in one of the vials. The nucleation event is an exothermic event which raises the temperature of the product and vial to near 0 C. In a closely packed array of vials, the nucleating vial prevents adjacent vials from nucleating by adding releasing heat and increasing their temperature. Before the adjacent vials can nucleate, the nucleating vial must complete the ice crystallization process and reduce in temperature. Once the available water in the product is crystalized and the exothermic reaction energy is reduced, another adjacent vial can nucleate. This process results in vials nucleating at differing temperature and rates, which produces differing ice structures in the vials. The result is a primary drying cycle that can only sublimate at the rate of the vial with the least favorable ice crystal structure, and therefore a longer than necessary primary drying cycle is necessary. When a small batch of product is used, the vials will nucleate and freeze faster resulting in a crystal much different than a large batch and therefore will produce different results.

To produce a more consistent crystal structure across the batch a method of controlled or forced nucleation can be applied wherein the liquid product is super-cooled to a predetermined temperature and then an activation event is created which forces the nucleation process. Typically, all vials nucleate at the same time, temperature, and rate which results in very uniform initial crystal structure across the batch. For more consistent intra-vial crystal structure a method for controlling heat flow may be added after controlled nucleation occurs.

If controlled nucleation is performed, only a fraction of the available water crystalizes, and the majority of crystal growth occurs post-nucleation. Controlling the heat flow after nucleation is critical to produce a more uniform intra-vial crystal structure, enabling shorter primary drying times and improving product consistency and quality.

Drying—Once the product is frozen, the pressure in the chamber is reduced and primary drying may begin.

Freeze drying requires a process to efficiently remove water without losing the product matrix structure created during the freezing step. The key to an optimized drying cycle is keeping the product at a temperature slightly below its critical temperature, which is the product temperature above which the product melts and/or the matrix collapses. The critical temperature is determined by the operator and may be either the measured eutectic, glass transition or collapse temperature, whichever is highest in temperature. There may also be applications when some form of collapse is required. The process to efficiently remove water without losing the product matrix structure can be monitored, optimized and controlled for these applications.

From a process development perspective, cycle optimization results in a shelf temperature and chamber pressure combination that balances the heat and mass flow and maintains the product at its optimum temperature. Traditionally this is a very challenging task which involves a multi-step 'trial and error' approach, and is further complicated by the differing heat transfer dynamics between freeze dryers and batch sizes. This approach can result in large amounts of wasted product if multiple runs are required to achieve cycle optimization.

Heat transfer during freeze drying is a dynamic process. The total amount of heat applied to the product comes from a combination of sources including: the shelf; gas conduction; convection; radiation and inter-vial heat transfer. The proportion of the total heat from each source differs due not only to equipment and application differences, but also due to interaction between the vials.

Heat transfer to the product during primary drying occurs through several modes of heat transfer, for example:

QShelf—heat source a. Contact conduction from the shelf to the vial b. Gas conduction from the shelf to the vial QVials—cooling effect during sublimation a. Contact conduction between the vials b. Gas conduction between the vials QOther—heat source a. Gas convection between the vials b. Radiation from the walls, door, shelf above, and other vials $$Q\ \text{total} = Q\ \text{shelf} + Q\ \text{Vials} + Q\ \text{Other}$$

The total energy required to complete sublimation is: Q total=Heat of Sublimation*Quantity of WaterDuring sublimation the shelf temperature is controlled to add heat to the product causing the ice to sublimate into vapor. Sublimation is an endothermic event, which results in a low product temperature at the sublimation front. Although the shelf may be at −15° C. the product at the bottom of the vial may be −20° C. and the temperature at the sublimation front will be at the lowest temperature, for example −35° C. When freeze drying large batches of vials, the majority of vials are surrounded by at least two outside rows of vials and there are multiple rows of vials, there is a significant amount of inter-vial cooling which slows the sublimation process. When a small batch of product is freeze dried there are a significantly larger percentage of edge vials and the inter-vial cooling effect is greatly reduced and therefore the sublimation rates are much higher.

Center vs Edge Vial—(FIGS. 1A, 1B) A "center vial" may be defined as a single vial surrounded by at least two outside rows vials. The vast majority of vials in a larger freeze dryer are considered center vials. Center vials are exposed to minimal radiation heating and experience a cooling effect from their surrounding vials that are sublimating which results in slower freezing, lower sublimation rates, and longer drying times.

An "edge vial" can be defined as a vial that is not surrounded by two outer rows of vials. An edge vial will experience a greater amount of heat from radiation and less inter-vial heat transfer effects from surrounding vials, which results in faster freezing and faster drying times. The outer 2 to 3 rows of a tray of vials experiences an "edge effect" resulting in shorter drying times than center vials. Therefore, a small batch of vials will act more like edge vials than center vials and will therefore freeze faster and dry faster. In a 19 vial nest arranged in a hexagonal pattern (FIG. 2), the outer 2 rows are edge vials, so 18 of the 19 vials act like edge vials. A goal in freeze drying is to have the vials process uniformly for consistency and repeatability, the edge vial effect needs to be minimized to produce a consistent product.

The rate of freezing and sublimation is determined by the combined heat flow of all of the heat sources. The sources of heat flow vary between freeze dryers and batch sizes and therefore freezing and primary drying times vary. In addition, the variation in heat sources can produce differences in the dried product across the batch.

Experiments—Table 1 (Appendix A)—To test the effect of different heat sources a series of experiments was executed. A full tray of product (12"×24") was processed in a laboratory scale freeze dryer and the primary drying time was measured. Next 19 vials were processed in the same laboratory scale freeze dryer using the same freeze drying protocol. The 19 vials dried in 512 minutes versus 636 minutes for a full tray. The drying time for 19 vials was over 120 minutes shorter.

Based on common theory the faster drying when 19 vials are processed is caused by a larger percentage of the vials being exposed to radiation from the warm walls and door of the freeze dryer. In an effort to understand and control this variation, experiments were performed using a temperature controlled wall in a small freeze dryer. A small scale freeze dryer having a 6" diameter shelf and a temperature controllable wall was developed. 19 vials were placed in the small freeze dryer and the sublimation uniformity and sublimation times were measured. The sublimation uniformity was measured at a point where approximately 25% of the water should have been removed. Each vial was weighed and the amount of water removed and the percentage dryness was determined. Next the temperature of the wall was reduced to −40C to minimize radiation from the wall. Then in successive runs insulation was added around the product to shield the vials from all potential sources of radiation.

In all cases the 19 vials dried significantly faster than a full tray. Reducing the wall temperature results in reduced heat transfer from radiation sources. However, experiments with the wall temperature reduced to −40C and with the vials insulated from any potential radiation sources resulted in a minimal change in primary drying time and minimal improvement of sublimation uniformity across the batch of vials. Therefore, reducing the temperature of the wall and implementing a radiation shield had marginal effect on the process and was not able to simulate the processing times of larger systems and larger batches of product.

Conclusion: The difference in drying times between large and small batches is not predominately a result of radiation, since minimizing radiation minimally improved the sublimation rate and uniformity across the batch. It was then hypothesized that there is a major heat transfer effect from vials being surrounded by other vials. So, another set of experiments would need to be developed to test the theory that there is a reduction in sublimation rate and better sublimation uniformity when vials are completely surrounded by other vials.

What is needed is an apparatus and method for simulating and quantifying the heat transfer dynamics created by the inter-vial heat transfer dynamics from adjacent vials in large batches, in both freezing and primary drying, when only a small batch of product is used, for example 1 to 37 vials. A method and apparatus to simulate the heat flow from adjacent vials enables the user to test the limits of operation, simulate the heat transfer dynamics of larger systems and larger batches, develop optimized freeze drying protocols, and develop transferrable protocols for a particular product.

There are many methods to transfer protocols once an optimized protocol is developed. One example of a method to transfer an optimized primary drying protocol is to determine the Thermal Conductivity of the Vial (Kv) in both the SFD an TFD, then use the Kv values to determine the TFD shelf temperature based on the SFD shelf temperature.

Example of one method to transfer the protocol from primary drying from a SFD to TFD:

$$Tshelf\ \ TFD = \left(\left(\frac{KvSFD}{KvTFD}\right) * (Tshelfsource - Tproductsource)\right) + Tproduct$$

Definitions:

TshelfTFD—Target shelf surface temperature (degrees C.)

KvSFD—Vial Thermal Conductivity Source Freeze Dryer

KvTFD—Vial Thermal Conductivity Target Freeze Dryer

Tshelfsource—Source shelf surface temperature

Tproductsource—Source product temperature

Tproduct—Target product temperature

SUMMARY OF THE TECHNOLOGY

Freeze drying process monitoring and control can be enhanced by reacting to heat flux changes detected before temperature changes occur. One method of measuring heat flux is to use surface heat flux sensors that are designed to obtain a precise direct reading of thermal transfer through a surface in terms of energy per unit time per unit area.

The function of a surface heat flux sensor is to measure heat transfer (loss or gain) through the surface where it is mounted. It does this by indicating the temperature difference between opposite sides of a thin layer of separator material attached to measuring surfaces, thus providing a direct measurement of the heat loss or gain.

The freeze drying process has two major steps: freezing and drying. Each step involves a different heat transfer dynamic between the shelf and product. Freezing is a cooling process with the heat transfer from the vial to the shelf. Drying is a heating process from the shelf to the product.

Using a heat flux sensor, both the freezing and drying steps can be monitored and controlled in a fashion that direct temperature measurement and other methods do not allow. The heat flux measurement method, therefore, provides a control of the entire process and is an in-situ Process Analytical Technology (PAT).

To produce a consistent crystal structure it is necessary to understand the major events that occur during freezing:

1—Nucleation;

2—Crystal growth in the freeze concentrate; and

3—Freeze Concentration (amorphous product) of the maximal freeze concentrate or freeze separation (eutectic product)

If each of these steps can be monitored and controlled, it is possible to produce a consistent crystal structure across an entire batch as well as inside each vial and therefore produce a significantly more consistent final product and even reduce the time of the primary drying phase.

1—Nucleation

The goal for nucleation is to have all of the vials nucleate at the same time, same temperature and at the same rate. The result will be a consistent starting point for controlling crystal structure. Controlled nucleation provides the basis for control of the entire freezing process by providing a consistent starting point for all of the vials. To produce a controlled nucleation event the vials are cooled to a point where the liquid is super-cooled and all the vials have stabilized at a predetermined temperature. Once stable, a catalyst event is introduced to produce the nucleation event. The vials, for example, might be cooled to −5C and held for 45 minutes to ensure the product is stable. The seeding crystals are introduced into the product chamber inducing nucleation in the vials. The advantages of this approach include simplicity of implementation and low cost.

To ensure that the vials have reached the predetermined temperature, the present method can be used to sense that the heat flow into the vials has dropped to a level where there is no more temperature change taking place. This is done without the use of thermocouples in the vial.

It is important to note that controlled nucleation by itself does not significantly reduce primary drying times. Controlled nucleation provides a homogeneous starting point, but it is the control of crystal growth that can produce a reduction in primary drying time.

2—Crystal Growth

The remaining unfrozen material post-nucleation is an equilibrium freeze concentrate. As the shelf temperature is reduced further energy is removed from the vial. The rate of crystal growth during this freezing step is typically not controlled and the changing heat flow results in an inconsistent ice structure inside the vial. Another factor that affects the rate of crystal growth is heat transfer efficiency of the equipment. Different finishes on the shelf, different heat transfer fluids, and different heat transfer fluid flow rates all have an effect on heat transfer efficiency. During the freezing process the equilibrium freeze concentrate crystalizes and forms a maximal freeze concentrate (Wg'). For example: sucrose has a maximal freeze concentrate of 20% water and 80% sucrose.

One of the main challenges during this stage of freezing is that temperature change does not occur during the phase change from liquid to solid and the rate of change is a result of heat transfer efficiency, which is different in each piece of equipment and for each application.

In situations with uncontrolled nucleation and controlled freezing the crystal structure at the bottom of the vial is smaller than at the top. This results in non-uniform drying and the potential for melt-back or collapse. This is evident by shrinkage at the bottom of the cake toward the end of primary drying.

3—Freeze Separation or Concentration

Once the equilibrium freeze concentrate fully crystallizes, the process has reached the end of latent heat removal and the remaining maximal freeze concentrate begins to separate (eutectic) or concentrate (amorphous). By using the present method, a heat flow rate can be chosen and the rate of crystallization can be controlled until the product temperature is reduced below its eutectic or glass transition temperature. Control during this process produces a consistent structure throughout the maximal freeze concentrate.

Design Space Determination

With the heat flux measurement information a cycle optimization design space can be defined and plotted. Product temperature isotherms, along with shelf temperature isotherms, can be plotted on a mass flux vs chamber pressure diagram. The resulting information can be used to select the optimum shelf temperature and chamber pressure for highest throughput possible in a specific freeze dryer. This quality by design approach maximizes process and product understanding with a minimum of experimentation.

Using the heat flux measurement method one can plot cycle optimization design space with just two cycles run. First, an ice slab sublimation test is performed to find the equipment limit lines. Second, a single product sublimation test is performed to plot all the shelf temperature isotherm lines. The traditional method to calculate vial heat transfer resistance (Kv) via weight loss requires a single vacuum set point per run, and several vacuum set points are required. This makes it an extremely lengthy and expensive process.

Another benefit from the heat flux method is limited product samples are required to finish the test run as long as they can cover the area of the sensor. Other methods like TDLAS require many more samples to generate enough vapor flow for accuracy of measurement.

In addition to ensuring that a protocol developed in a small lab freeze dryer is repeatable in a large production freeze dryer, the heat flux measurement method allows a Production Freeze Dryer to be characterized and then simulated on a lab scale unit. For example, the heat flux of an existing protocol can be measured and then repeated in a small system. Typically this is very difficult since the system performance and heat transfer dynamics are much different. Scaling from the lab to production is a major problem in the industry. The main advantage of controlling nucleation and controlling the heat flow is that the freezing profile developed in any freeze dryer can be transferred completely successfully into any other freeze dryer.

Solution to the Problem Related to "Edge Vial Effect"—Apparatus:

A temperature controlled surface (Thermal Emulator) with a temperature range of −80° C. to +105° C. or better that is in contact or close proximity to the vials. When processing a small batch of vials the edge vials may be temperature controlled and therefore the edge vial effect can be controlled and eliminated.

a. The apparatus can be designed to be in contact or close proximity to the vials
b. The apparatus may use thermal conductors to transfer heat to/from the vials Thermal Conductors which can be made from various materials, in various configurations and sizes, can be used to better enable the thermal transfer. These may be solid or flexible in nature and may be fluid filled if need be.

The contact to the surface of the vials, whether it be directly to the temperature controlled surface or via a thermal conductor, can be aided using a thermal conductive paste, fluid, or other material, or using a flexible membrane, that may or may not be fluid filled, that can expand and contract.

The method of temperature control includes but is not limited to direct refrigeration, recirculating fluid, thermoelectrics, LN2, forced air or gas, or any other appropriate method.

The Thermal Emulator temperature can be controlled by programmed steps of from product temperature feedback using an appropriate product temperature sensing method, or other method to be defined later.

The apparatus can be mounted in small dedicated freeze dryer or can be installed and implemented in any freeze dryer for temporary or permanent use.

With the ability to process small batches additional features may be added to enable the user to study the process and determine critical process parameters, to optimize protocols, and develop protocols that are transferable to other freeze dryers.

It is an aspect of the present technology to provide an apparatus and methods for processing a small sample of vials more uniformly by simulating the conditions of 'center vials' and eliminating the 'edge vial effect'. The method and apparatus simulates the heat transfer dynamics created by the interaction of adjacent or surrounding vials during the freezing, primary drying and secondary drying cycles, while using a small batch of product, for example 1 to 37 vials. The method and apparatus enable a small batch of vials to be used for measurement, analysis, optimization, and simulation of larger freeze drying batches. These together with other aspects and advantages which will be subsequently apparent, reside in the details of construction and operation as more fully hereinafter described and claimed, reference being had to the accompanying drawings forming a part hereof, wherein like numerals refer to like parts throughout.

BRIEF DESCRIPTION OF THE DRAWINGS

Further features and advantages of the present device, as well as the structure and operation of various embodiments of the present device, will become apparent and more readily appreciated from the following description of the preferred embodiments, taken in conjunction with the accompanying drawings of which:

FIG. 2 is a top plan view of a 19 vial nest of vials with indications of center and edge vials;

FIG. 7 is a model of one possible configuration inside a freeze dryer where thermal conductors are located in slots in a thermal emulator ring;

FIG. 8 is an example thermal emulator mounted inside a development freeze dryer chamber;

FIG. 15 is a perspective view of a circular fluid filled vessel around a 19 vial nest;

FIG. 16 is a perspective view of a hexagonal fluid filled vessel around a 19 vial nest;

DETAILED DESCRIPTION OF THE TECHNOLOGY

Figure 1:
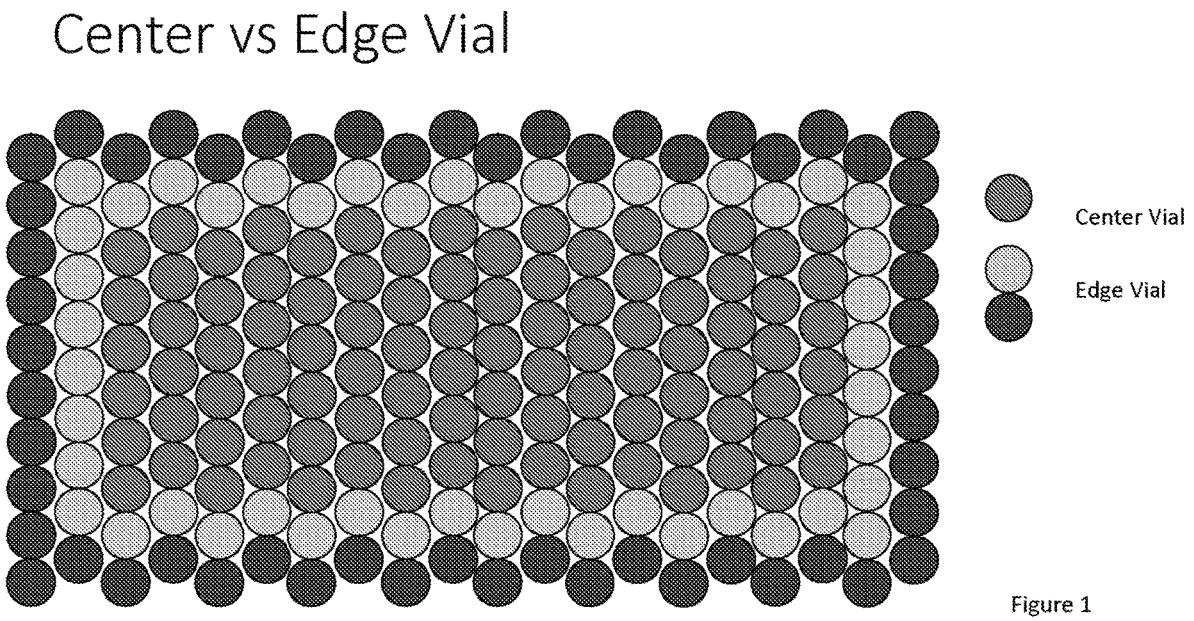
FIG. 1 is a schematic top plan view of a number of vials in a tray indicating those that are "edge vials" and those that are "center vials"
Figure 3:
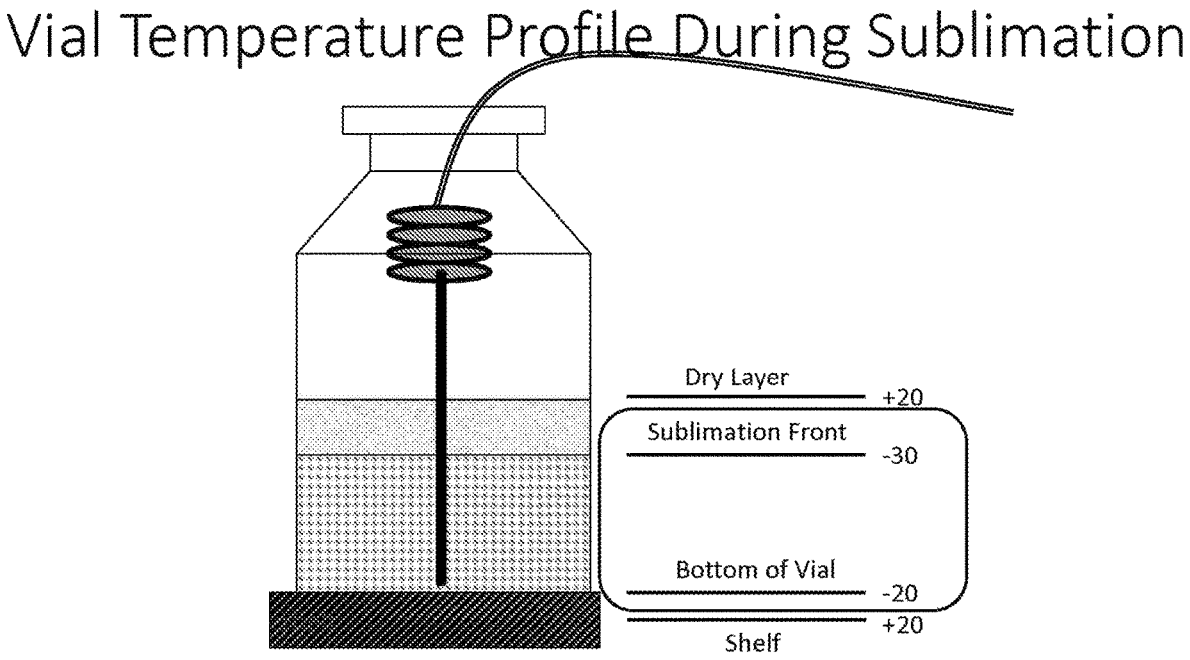
FIG. 3 is a side elevational view representative of the temperature profile inside a vial undergoing sublimation.
Figure 4:
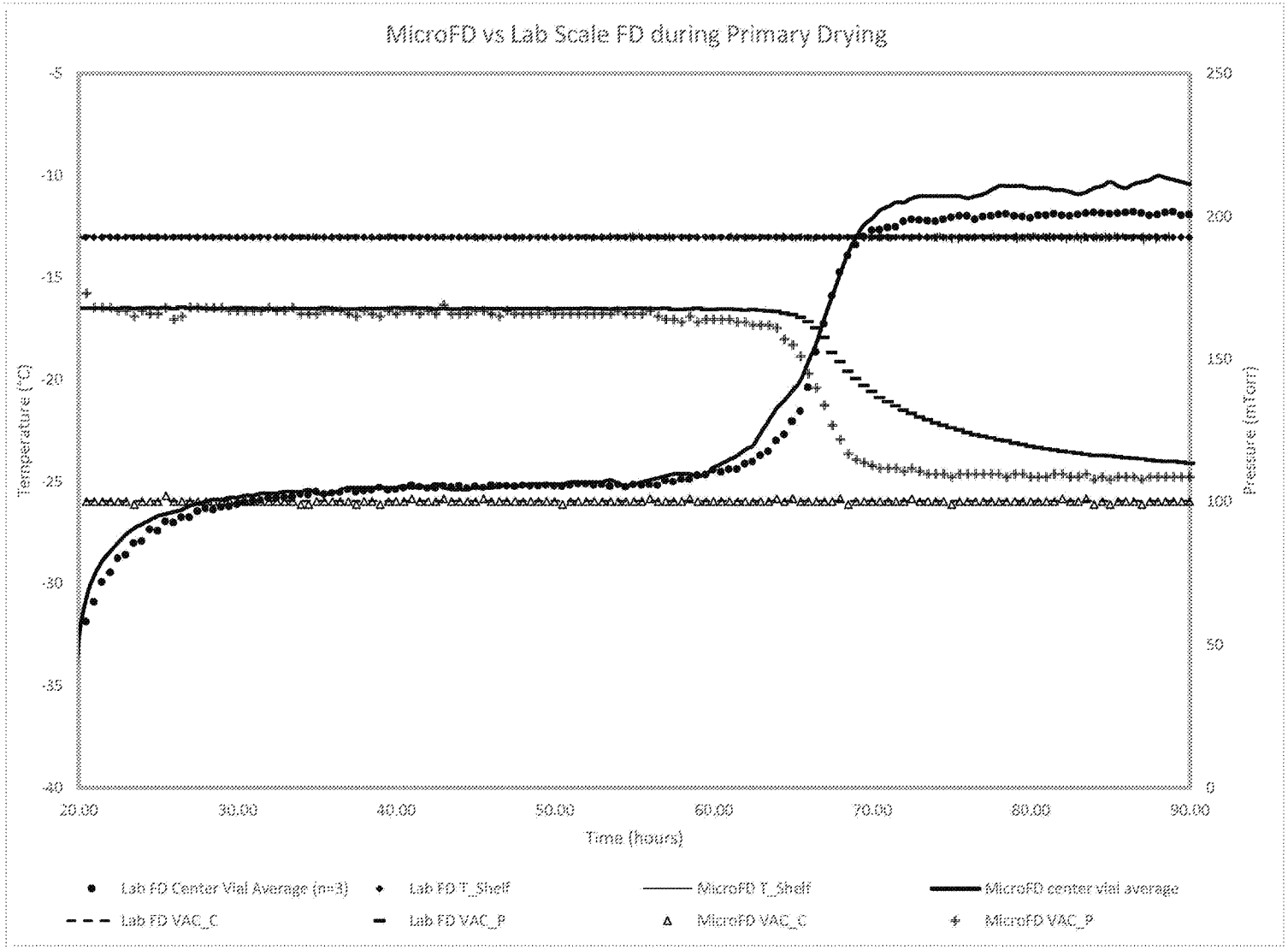
FIG. 4 is a graph showing the temperature profile comparison between a development freeze dryer and a larger batch target or laboratory freeze dryer to demonstrate the ability to simulate the target freeze dryer.

This description of the exemplary embodiments is intended to be read in connection with the accompanying drawings, which are to be considered part of the entire written description. In the description, relative terms such as "lower," "upper," "horizontal," "vertical," "above," "below," "up," "down," "top," and "bottom," as well as derivatives thereof (e.g., "horizontally," "downwardly," "upwardly," etc.) should be construed to refer to the orientation as then described or as shown in the drawing under discussion. These relative terms are for convenience of description and do not require that the apparatus be constructed or operated in a particular orientation. Terms concerning attachments, coupling and the like, such as "connected," and "interconnected," refer to a relationship wherein structures are secured or attached to one another either directly or indirectly through intervening structures, as well as both movable or flexible or rigid attachments or relationships, unless expressly described otherwise. 'Vial' will refer to any container type, such as vial, syringe, tray, well plate, or any other container used to hold the product. 'Development' (or DFD) or 'Source' or (SFD) shall refer to the freeze dryer that is being used to analyze, create, simulate a larger batch target freeze dryer for the purpose of producing a protocol that can be transferred. 'Target' (or TFD) shall refer to the freeze dryer that will be receiving the transferable protocol. 'Protocol' will refer to the recipe, profile, process, or steps that defines the shelf temperature and product chamber pressure or other critical process parameters for a specific order of operations for a freeze drying application. 'Adjacent vial' or 'surrounding vial' refers to a vial that is close proximity or in contact with another vial. A single vial can have a maximum of 6 adjacent vials or be surrounded by 6 vials. 'Center vials' refers to vials that are surrounded by at least two outside rows of vials, 6 in the first outside ring and 12 in the second outside ring. 'Edge vial' refers to a vial that is surrounded by less than two outside rows of vials. 'Edge vial effect' refers to the difference in freezing and drying conditions for edge vials versus center vials. The 'Thermal Emulator' consists of a temperature controlled surface that is in close proximity to the vials, and may or may not include a 'thermal conductor' or other heat transfer device, material, or method to aid in conduction from the thermal emulator to the vials. The 'thermal conductor' or heat transfer device, material, or method may or may not be integral with the 'thermal emulator' and may be in contact or close proximity to the vial. A 'batch' refers to the product placed in the freeze dryer and can be one or many vials or containers. A 'nest' is a small batch of product, such as a group of 19 vials packed together.

The present technology relates to a design, apparatus, and method to use a small sample of a product, for example 1 to 37 vials, in small Development Freeze Dryers ("DFDs") to develop freeze drying protocols that enables an optimized protocol to be developed and easy transfer to larger systems. The method and apparatus simulate different heat transfer conditions, such as those of larger freeze dryers or larger batches, also referred to as "Target Freeze Dryers" or "TFDs" while using a minimal amount of product, as few as 1 to 37 vials or product containers in some instances, with the intent to develop transferrable protocols to any sized system or batch. The key to creating these protocols for larger batches when using a small sample of product is simulating the center vial conditions and eliminating the edge vial effect by simulating the heat from different sources that would be expected in the larger batch, such as conduction from the shelf, radiation from the walls and door, and inter-vial or inter-container dynamics.

Most freeze drying experimentation and protocol development is done in 6 to 10 square foot freeze dryers which requires a significant amount of product and time. With new drug costs increasing, a method to reduce the amount of product used and reduce the time of development is needed. As mentioned above, simulating a freeze drying protocol includes three major steps, each having their unique heat transfer characteristics, including; freezing, primary drying (sublimation), and secondary drying (desorption). Each of these steps need to be controllable. Initial attempts at developing a freeze dryer for small batches, for example 1 to 37 vials, included experimentation with temperature controlled walls to reduce the radiation and other heat input, however, testing has shown that the method of a fully decoupled temperature controlled wall does not produce sufficient results to simulate large batches of vials.

While the current concept could be applied to a wide variety of conditions and circumstances, there are two areas of interest for process simulation, which will be discussed in further detail here, namely "center vials" and "edge vials". (See FIGS. 1, 2). Typically, center vials freeze slower and dry (sublimate and desorb) slower than edge vials. Center vials are each surrounded by at least two outside rows of vials with 6 of those vials being adjacent. Edge vials are typically the outer 2-3 rows of vials on a shelf. An edge vial may have as few as 2 or 3 adjacent vials. Note that the more vials placed on a shelf the smaller the % of edge vials and the larger the % of center vials.

Figure 5:
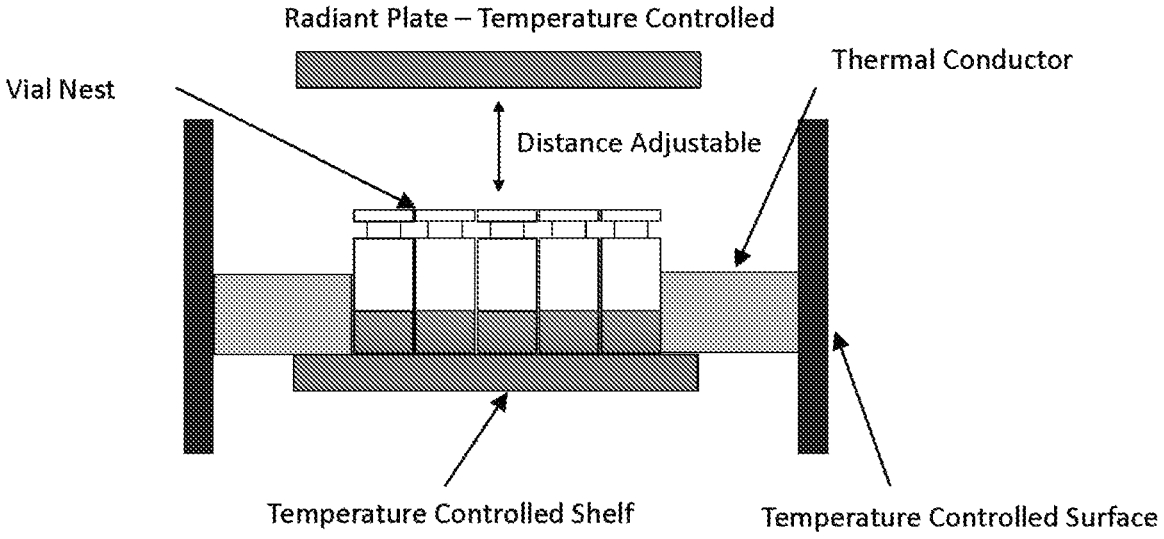
FIG. 5 is side elevational view showing the concept of the apparatus in a Development Freeze Dryer ("DFD") according to one embodiment.
Figure 6:
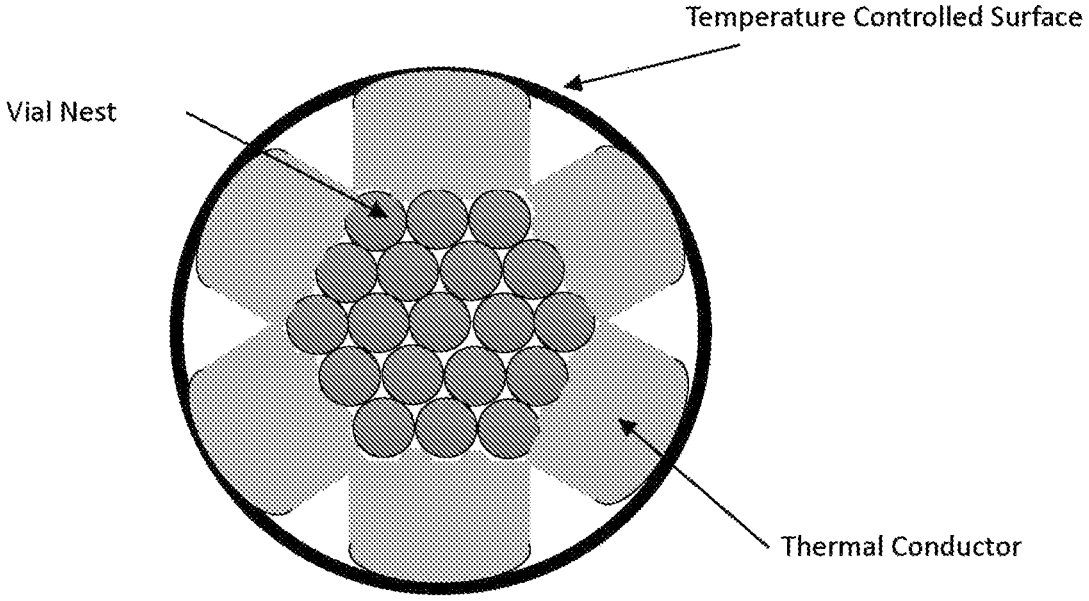
FIG. 6 is a top plan view of a vial nest in a Development Freeze Dryer ("DFD") according to one embodiment.

The purpose of the present concept is to enable the development of a robust or optimized protocol using a minimal amount of product by eliminating the edge vial effect and mimicking the performance of the target batch as closely as possible to enable an improved or optimized freeze drying profile to be produced, while collecting critical process information that can be used to aid in the development of the target protocol. A method and apparatus is required that can effectively simulate the heat transfer dynamics of larger batches and collect the critical process information. In an embodiment, a method and apparatus can use a thermal emulator closely coupled to edge vials under test to produce conditions similar to those experienced by center vials in a larger batch or TFD. (See FIGS. 5 and 6)

To produce the center vial conditions, a thermal emulator can be placed in close proximity or against the vials or a thermal conduction contact block can be used to conduct between the vials and the thermal emulator. (See FIGS. 5 and 6) This produces a heat flow path that can be adjusted to simulate the local heat flow of the center vials.

Edge vial conditions can also be simulated by controlling the temperature of the thermal emulator with or without the conduction blocks to simulate the radiation and convection that an edge vial may be exposed to. In addition, a corral or other containment may be added to the vial nest to more accurately simulate local conditions of the edge vials.

In an alternative embodiment, a thermal conductor could be integrated with the thermal emulator as a single entity. The conducting surface can then be made adjustable to make contact with vials located at varying distances from the thermal emulator.

The thermal emulator can be of any design such as coiled tubes, an annular shell or any other design or shape. It may be temperature controlled using a circulating fluid, thermoelectric devices, refrigerant direct expansion or any other cooling/heating method. Similarly, it may be heated using circulating fluid, circulating gas, heat pads, or any other heating method known in the relevant art. Additionally, the surface may be designed to have different radiant properties from fully reflective to a black body.

The thermal conductor can be made from any suitable material, such as borosilicate glass, conductive paste, fluid filled container, metal, ceramic or plastic. It may be designed to provide a snug fit or to have a spring loaded function or other method to ensure good contact or close proximity to the vials. The conductor may be designed to have a close proximity, a single point of contact, multiple points of contact, or intimate contact with the vials and the thermal emulator. Additionally, the surface may be designed to have different radiant properties from fully reflective to a black body.

In addition to controlling the shelf temperature, chamber pressure, and a method to control the wall temperature of the outside vials the DFD can also be supplied with:

Controlled Nucleation—Millrock U.S. Pat. No. 8,875,413

Heat Flux Monitoring and Control—Millrock U.S. Pat. No. 9,121,637

Implementation of the present heat flux measurement method in a freeze drying process control opens a new door to optimization and enables a validation trail of the freeze drying cycle. It is based on continuous real time measurement, as opposed to other techniques which only take occasional batch based average estimates or calculations after the cycle is finished. It works throughout the cycle from freezing to the end of drying. It can be easily transferred from lab scale to production as a true Process Analytical Technology (PAT).

Using heat flux to verify the process in-situ can confirm, for the first time, that the process has performed within acceptable parameters. In addition, feedback can be used to prevent damage to the product in process before it happens, in events such as equipment malfunction.

Heat flux sensing provides information that can identify process changes that could accidently occur, such as a change in vial, formulation changes, freeze drying machine performance and other critical parameters that previously have not been measureable.

During a power loss, the cake structure could be affected. Heat flux sensing could be used to confirm that no negative effects in cake structure have occurred, thus saving a batch product.

Using a surface heat flux sensor has major advantages over all other methods for monitoring and controlling a freeze drying process including:

1. Can be used for both the freezing and drying portions of the freeze drying process;

2. Minimally invasive-does not change the heat transfer mechanism;

3. Real-time, continuous measurement;

4. Can be installed on all freeze drying equipment from lab to production scale;

5. Works with both internal and external condenser configurations;

6. Can be used to determine end of primary drying;

7. Eliminates the need for multiple product runs at different pressures to determine an acceptable performance envelope;

8. Acts as a PAT tool and enables real-time monitoring and control of the process, from laboratory to production;

9. Provides in-situ information for Quality by Design with minimum cycle runs;

10. It is equipment and container independent allowing seamless cycle transfer;

11. Is batch size independent, works from a small lot to a full load (MTM and TDLAS require a large batch);

12. Performs direct measurement and does not rely on estimates in calculations (MTM requires that the volume of the chamber be estimated);

13. Can identify changes in critical process parameters, i.e., vial construction, formulation, equipment performance, etc.;

14. Can be used to verify cake integrity post power failure or other equipment or process failure;

15. Low cost; and/or

16. Can be easily implemented.

The heat flux sensor can be implemented in various ways. For example, on most laboratory scaled systems the sensor can be mounted on the top surface of the shelf, while on production scale systems it may be embedded inside the shelf. The mounting location is not limited to the shelf for monitoring and control. It may also be mounted on the walls or other surfaces of the freeze drying apparatus that are near the vials or bulk product and may have a significant heat transfer effect on the process.

Any suitable type of heat flux sensor may be used. As an illustrative example, a low thermal capacitance and low thermal impedance heat flux sensor is suitable for this type of application.

Figure 18:
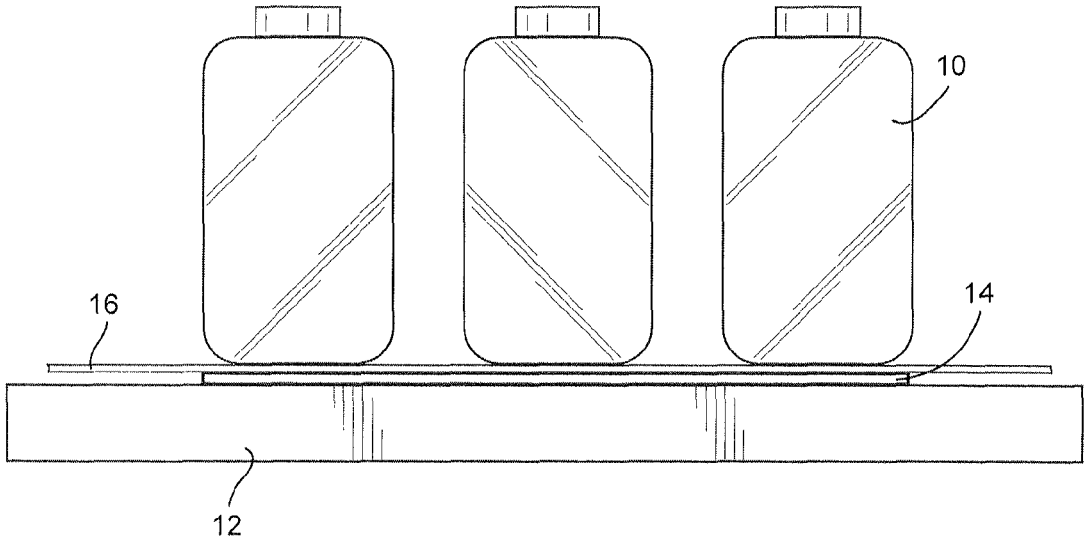
FIG. 18 is an elevational view of a portion of a shelf in a first embodiment of a freeze drying apparatus having one or more product vials mounted thereon with a heat flux sensor mounted on the top surface of the shelf beneath the vials.

As shown in FIG. 18, one or more product vials 10 are mounted on the center or other portions of one or more shelves 12 in a freeze drying apparatus so as to be representative of the product vials (not shown) in other positions on the shelves 12. One or more heat flux sensors 14 are mounted on the upper surface of the shelves 12 and/or adjacent walls (not shown). A stainless metal foil or other layer 16 expediting heat transfer may be positioned between each heat flux sensor 14 and the product vials 10 to insure accurate measurement of the heat loss or gain between the product vials 10 and the shelves 12.

Figure 19:
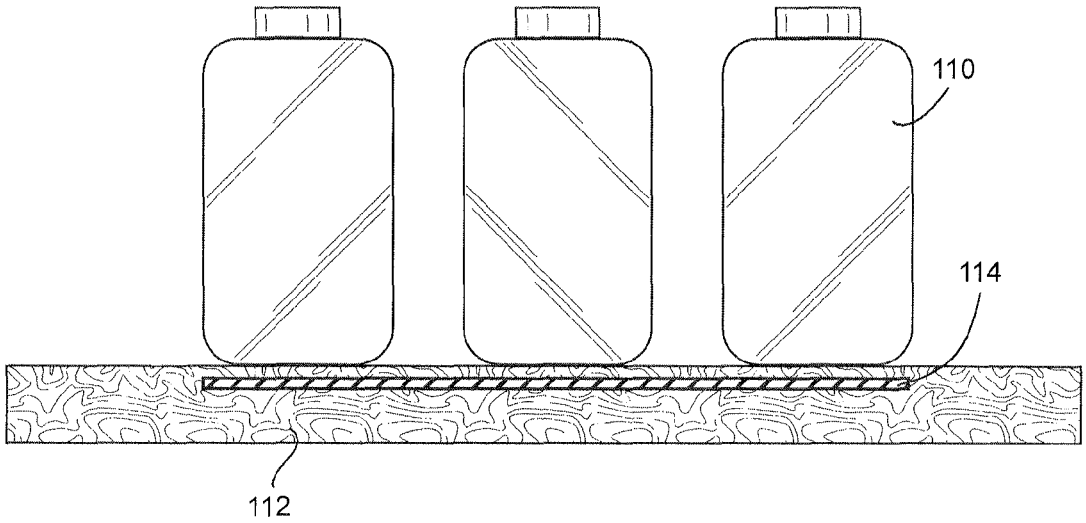
FIG. 19 is an elevational view of a portion of a shelf in a second embodiment of a freeze drying apparatus having a heat flux sensor embedded in the shelf beneath one or more product vials mounted on the shelf.

A modified embodiment is shown in FIG. 19 wherein one or more product vials 110 are mounted on the center or other portions of one or more shelves 112 in a freeze drying apparatus and one or more heat flux sensors 114 are embedded inside the shelves 112 and/or adjacent walls (not shown) beneath or adjacent to the product vials 110.

As illustrative examples, the embodiment of FIG. 18 may be used in laboratory scaled systems and the embodiment of FIG. 19 may be used in production scale systems.

Figure 20:
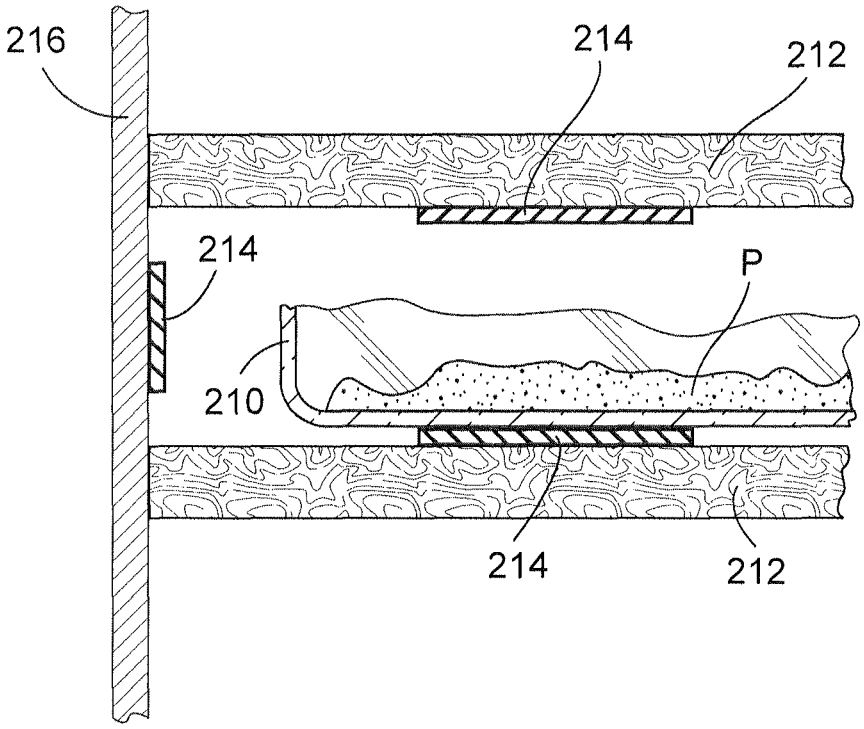
FIG. 20 is an elevational view of a portion of a third embodiment of a freeze drying apparatus wherein one or more heat flux sensors are mounted on walls or shelves that are in contact with or adjacent to bulk product to be freeze dried in the apparatus.

A third embodiment is shown in FIG. 20 wherein bulk product P to be freeze dried is placed in a tray or trays 210 mounted on one or more shelves 212 of a freeze drying apparatus having walls or other surfaces 216. One or more heat flux sensors 214 may be mounted on the shelves 212 adjacent to and above or below the bulk product P. One or more heat flux sensors 214 may also be mounted on the walls or other surfaces 216 of the freeze drying apparatus adjacent to bulk product P on the shelves 212. The heat flux sensors 214 are mounted in selected positions on the shelves 212 or walls 216 adjacent to selected bulk product P so as to be representative of all of the bulk product in the freeze drying apparatus. The heat flux sensors 214 may be mounted on or embedded into the shelves 212, walls 216 or other surfaces adjacent to the bulk product P.

In order to create the most consistent crystal structure in the vial and across the batch a common starting point and a method for controlling the rate of crystal growth is required. Controlled nucleation provides a common starting point by nucleating all the vials at the same temperature, rate, and time. Once the vials are nucleated crystal growth begins in the unsaturated solution. By measuring the heat flow during crystal growth the freezing rate can be determined. Combining this information with the latent heat of ice, it is possible to predict the end of latent heat removal and the end of unsaturated solution crystallization if the heat flow can be controlled.

In most freezing profiles the shelf temperature is ramped to a low temperature at a controlled rate, for example to −40° C. at 0.5° C./min. When the heat flow is monitored it is very apparent that the crystal growth changes dramatically during the crystallization process. With feedback from the heat flux sensors the shelf temperature can be controlled to keep the heat flow at a predetermined level throughout the crystal growth phase of freezing. The result is a homogeneous ice crystal structure throughout the vial and throughout the batch. The crystal growth can be controlled at different rates to develop different crystal sizes.

The heat flux sensor provides in-process information for Heat Flow (dq/dt). With this information a series of calculations can be performed to provide critical information for control of the freeze drying process. Three critical parameters can be determined, including the Vial Heat Transfer Coefficient ($K_v$), Mass Flow (dm/dt), and Product Resistance ($R_p$). The calculations enable the process parameters to be predicted instead of using the typical 'after-the-fact' open-loop control feedback of thermocouples. This makes heat flux based control a true process analytical tool. Once Kv has been determined the product temperature at the bottom of the vial ($T_b$) can be calculated, thus eliminating the need for a thermocouple for monitoring product temperature $K_v$-Vial Heat Transfer Coefficient Vial heat transfer coefficient $K_v$, is an important process variable which has a direct impact on product temperature during the drying step. Its value depends on vial physical properties, chamber vacuum level, and shelf surface finish.

One known method to calculate $K_v$ involves multiple sublimation tests which require the operator to perform a short run and then remove the product from the freeze dryer to measure the actual weight loss in a period of time after each test cycle. This process is performed for each different vacuum level to produce a performance curve. This approach is time consuming and error-prone.

Using the present heat flux measurement method, $K_v$ can be determined (calculated) in real time during the cycle without the time and labor intensive sublimation tests. Having in-process knowledge of $K_v$ totally eliminates the process uncertainty caused by heat transfer efficiency differences. One can calculate the product ice temperature based on shelf surface temperature of $K_v$.

Vial heat transfer coefficient ($K_v$) and Product Temperature ($T_b$) are very useful for Quality by Design (QbD). Any changes in vial characteristics and formulation can be identified.

$$\frac{dq}{dt} = K_v A_v (T_s - T_b) \Rightarrow K_v = \frac{\frac{dq}{dt}}{A_v (T_s - T_b)}$$

Where:

$\frac{dq}{dt}$ = Heat transfer measured from heat flux sensor $K_v$ = Vial heat transfer coefficient to be calculated $A_v$ = Outer cross section area of vial $T_s$ = Shelf surface temperature from measurement $T_b$ = Product temperature at the bottom center of a vial To calculate the $K_v$ a thermocouple is required to measure $T_b$. This is required one time only. Once $K_v$ has been determined, the $T_b$ can be calculated and the thermocouple eliminated.

Dm/dt—Mass Flow

Heat Flow measurement enables the control to be load sensitive. Traditional control on fluid inlet temperature has no real measurement of cooling or heating load on the shelf. A change in load results in a different thermal treatment profile on the product. This is a major obstacle for transferring a process to a different piece of equipment or different batch size. Control based on heat flow makes the process fully transferable and scalable to any size of machine and load.

Mass Flow information gives a real time estimate of when the primary drying cycle can be finished. Previously, end of cycle could only be detected when it happened. With heat flow measurement, it is possible to predict the end of a cycle right from the beginning. During the cycle any process parameter change causes a change in mass flow which can be monitored.

Heat Flow and Mass Transfer Equation:

$$\frac{dq}{dt} = \Delta H_s \frac{dm}{dt} \Rightarrow \frac{dm}{dt} = \frac{\frac{dq}{dt}}{\Delta H_s}$$

Where:

$\frac{dq}{dt}$ = Heat transfer measured from heat flux sensor $\Delta H_s$ = Heat of sublimination of ice $\frac{dm}{dt}$ = Mass transfer rate to be calculated Rp=Product Resistance Product resistance $R_p$ is the resistance to sublimation caused by a dry layer of the product. Its value depends on the ice crystal size, orientation and distribution which is a product of freezing. Most current equipment has no direct measurement of $R_p$. This means that there is no way to verify that the product was frozen the same way from batch to batch. With a real time reading of $R_p$ the ice matrix property can be verified from the moment drying process starts. During the drying process, if the process product temperature causes the dry layer to collapse or crack, a change of product resistance can be monitored in real time. This measurement offers a complete trace of product structure during the drying process, allowing process verification.

Mass Transfer and Product Resistance Equation:

$$\frac{dm}{dt} = \frac{A_p(P_i - P_c)}{R_p} \Rightarrow R_p = \frac{A_p(P_i - P_c)}{\frac{dm}{dt}}$$

Vapor Pressure Over Ice Equation:

$$P_i = 6.112e^{\left(\frac{22.46T_b}{272.62+T_b}\right)}$$

(Guide to Meteorological Instruments and Methods of Observation 2008)

Where:

$\frac{dm}{dt}$ = Mass transfer rate to be calculated $A_p$ = Inner cross section area of vial $P_i$ = Vapor pressure of ice calculated from ice temperature $T_b$ $P_c$ = Chamber pressure $R_p$ = Resistance of the dried product layer to be calculated $T_b$ = Product temperature at the bottom center of a vial The heat flow information can be used to determine:

Heat Flow

Freezing:

- determine that the product is ready for controlled nucleation;
- control the shelf temperature for controlled crystal growth;
- determine that the product has reached the end of freezing and is ready for primary drying;

Primary drying:

- Calculate the product temperature during the entire primary drying process;
- Determine the end of primary drying (when the heat flow approaches zero)

Product Temperature

Determine the product temperature through calculation to eliminating the need for invasive temperature measurement methods, such as thermocouples;

Verify the product did not rise above the critical temperature;

Feed back to the control system to adjust the shelf temperature to constantly keep the product below its critical temperature while maximizing the shelf temperature, thus reducing primary drying times.

Mass Flow

Calculate the end of primary drying time:

- Calculate the mass flow and remaining material to determine the amount of time that is left in primary drying;

Define a design space for equipment (QbD—Quality by Design):

- Adjust the vacuum level and shelf temperature to develop design space in a single run.

Process Analytical Technology (PAT)

To determine if any changes to the process have occurred, the heat flow will change. Process changes could be the result of, but not limited to:

- Vial characteristics
- Fill levels
- Equipment performance
- Other factors

Features:

- True Process Analytical Technology for monitoring and control of the entire freezing and drying process;
- QbD Tool for developing design space;
- Identify changes in process:
  - Change in vials;
  - Change in fill amount.
- Determine if collapse or melt-back is taking place.

From the foregoing description, it will be readily seen that the present heat flux method is simple, inexpensive, easily implemented and is a minimally invasive, reliable, efficient and accurate method for monitoring and controlling both the freezing and drying portions of the freeze drying process of different types of freeze drying apparatus.

The thermal emulator can be controlled via programmed steps or enabled to track the product temperature dynamically, thus mimicking the changing temperatures or changing heat flow of any measured vial, center or edge, or any other target temperature such as the vial wall.

Figure 9:
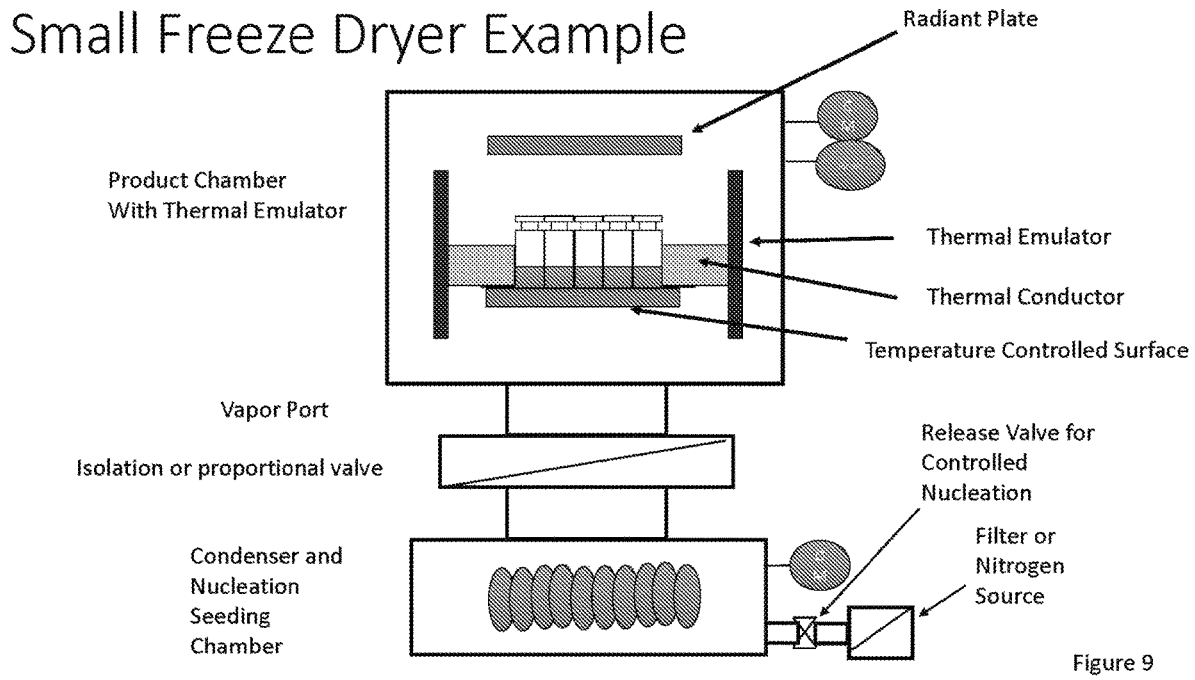
FIG. 9 is a schematic diagram of a small freeze dryer that includes a thermal emulator assembly placed in a small chamber, an isolation valve or proportional valve between the product chamber and condenser for simulating pressure drops between the chambers, an external condenser that can be used for controlled nucleation seed generation including a valve and filter, a capacitance manometer is located on both the product chamber and condenser and a pirani is located on the product chamber for performing end of drying determination and other process control situations.

A further improvement to the apparatus is the ability to control the pressure differential between the product chamber and condenser, to simulate larger batch production freeze dryer conditions. As shown in FIG. 9, a proportional valve is placed in the vapor port between the product chamber and condenser. The proportional valve can be adjusted to develop a restriction and therefore a pressure differential between the two chambers.

The apparatus can include any method of controlled nucleation or other freezing methodology to aid in optimizing the freezing process; any method for measuring, monitoring, and controlling the critical process parameters, such as 'manometric temperature measurement', heat flux measurement and control, tunable laser diode mass flow measurement, or near infrared dryness measurement.

The combination of these technologies provides the tools needed to analyze and control the process, to determine the critical process parameters such as thermal conductivity of the vial, as well as develop improved protocols using a very small batch of vials. These advantages include, but are limited to:

- Ability to simulate either center vials or edge vials, or any other condition experienced by a vial in a larger batch or TFD.
- Minimal sample size to minimize the cost of product required for protocol development
- Simplifies and speeds development of protocols
- Can be used to troubleshoot processing problems experienced with larger batches, such as those in pilot and production sized freeze drying systems
- Works in all phases of freeze drying including; freezing, primary drying, and secondary drying enabling the production of a completely optimized freeze drying protocol.
- Can be used to not only develop robust protocols, but can also be used optimize protocols by determining the conditions for proper freezing and reduced drying time
- Can be used to determine the critical process parameters enabling transfer of the improved protocol to larger batches or the TFD.
- Reduced cost of operation
- Space savings Previous Experiments—Appendix A—Previous experiments using a temperature controlled chamber wall, fully decoupled from the vials, in a small freeze dryer resulted in reduced heat transfer from radiation sources, but the proportion of heat flow from different sources was not balanced like larger systems and the drying times continued to be shorter than expected and therefore did not fully simulate the larger systems. Experiments with reducing the wall temperature and changing the wall surface for lower emissivity had marginal effect on the process.

Appendix:

a. Experiment 1—shows the sublimation uniformity in a small freeze dryer with the wall temperature at −40C;
b. Experiment 2—shows the sublimation uniformity in a small freeze dryer with the wall temperature at −40C and examples of thermal insulation to eliminate radiation;
c. Table 1—Shows the primary drying times of the same freeze drying protocol performed with different size batches and different edge conditions, without a thermal emulator;
d. Experiment 3—shows the improved sublimation uniformity when conducting the temperature of the temperature controlled wall to the outside row of vials in the nest;
e. Experiment 4—shows the further improved sublimation uniformity with a thermal emulator and thermal conductors contacting or in close proximity to the outside row of vials in the nest;

After analysis of these failed experiments, the inventor came to the conclusion that there must be another effect based on the size of the batch. Duplicate freeze drying processes were performed in a small freeze dryer and in a laboratory freeze dryer and the results indicated that there was either a major source of radiation in the small system or a cooling factor with larger batches. Experiments were performed in the small freeze dryer that reduced the wall temperature and shielded the vials from the walls preventing radiation, again the results were not satisfactory.

Conclusion: The faster drying times when processing small batches, for example 1 to 37 vials, is often referred to as the edge vial effect, which is more a result of loss of cooling from adjacent vials sublimating than radiation from warm surfaces. Sublimation, changing the state of ice to vapor, absorbs a significant amount of energy and reduces the temperature of the sublimating vial. Since sublimation is endothermic it is a cooling process and the center vials are surrounded by two or more rows which have a cooling effect on each other. Therefore a center vial experiences lower wall temperatures than edge vials. The sublimation of the adjacent vials dramatically reduces the energy available for the center vial, lowers the wall temperature of the center vial, and results in a reduced sublimation rate and therefore longer primary drying times of the center vial.

Sublimation rate experiment—To test the theory that the difference in sublimation rates is a result of adjacent vials having a cooling effect, the wall of the chamber in the small freeze dryer was closely coupled with the outer vials and the wall was cooled to simulate a temperature that a sublimating vial would produce.

The sublimation rate of each vial in the 19 vial stack was measured before and after adding the thermal conductors. The result of adding the thermal conductor was a significant reduction in drying rate (longer drying time) and an improvement in the uniformity of sublimation across the 19 vial batch.

Experiment 1 shows the uniformity of sublimation with a cooled wall that is fully decoupled.

Experiment 2 shows the results of attempts to eliminate radiation by insulating the 19 vial stack.

Experiment 3 shows the results of coupling the wall.

Experiment 4 shows a coil added to the chamber which is temperature controlled and thermal conductors between the coil and the vials to enable close coupling and temperature control of the outer or edge vials. The result is a significant improvement in sublimation rate uniformity. In addition, the primary drying time was very similar to that of a full tray in a laboratory (Revo®) freeze dryer.

Developing Protocols—Developing protocols can be performed by simulating the conditions for either center or edge vials in each mode of the freeze drying process; freezing, primary drying, and secondary drying. Below are examples of different processes that may be used. The freezing method produces the ice crystal structure that can impede or encourage primary drying, so multiple methods for freezing can allow the operator to compare and optimize the freezing method. Some methods of operation are described below, these are meant to describe different modes of operation and are not intended to define a limited scope.

1) Freezing—each of these methods can be performed with simulation of center vials or edge vials by controlling the wall temperature of the outside vials in the nest.
   a) Shelf temperature controlled as a sequence of ramps and holds
      i) Temperature of Thermal emulator adjusted via programmed steps
      ii) Temperature of Thermal emulator adjusted by tracking a measured product temperature of one vial or an average of several vials
      iii) Temperature of shelf adjusted by tracking the wall temperature of one vial or an average of vials.
   b) Same as 'a)' with an annealing step
   c) Same as 'a)' with a controlled nucleation event
   d) Same as "c)' with the shelf temperature controlled based on heat flow post-nucleation
   e) Reduce shelf temperature based on heat flow
      i) Temperature of Thermal emulator adjusted via programmed steps
      ii) Temperature of Thermal emulator adjusted by tracking a measured product temperature of one vial or an average of several vials
      iii) Temperature of shelf adjusted by tracking the wall temperature of one vial or an average of vials.
   f) Same as 'e)' with a controlled nucleation event
2) Primary Drying and Secondary Drying—each of the following methods can be performed while simulating either center or edge vials or any other vial condition by controlling the wall temperature of the outside vials in the nest using the thermal emulator in close proximity or contact
   a) Using #2 above, either simulating center or edge vials or other vial condition, and adjusting the temperature of the thermal emulator to a user entered program sequence
   b) If thermocouples or other temperature measuring devices are placed in the vials, they can be used as feedback to control the product temperature by adjusting the shelf temperature.
   c) Using 'b.' above to keep the product temperature just below the critical temperature.
   d) Using 'b' or 'c' above and automatically adjusting the temperature of the thermal emulator based on the changing temperature of the product e) Using #2 above, simulating either center or edge vial or other vial condition, and using heat flux monitoring and control to produce results similar to the TFD system.

f) Using 'e' above and adding product temperature control to keep the product temperature just below the critical temperature.

i) Method 'f' using a thermocouple or other temperature measurement device or method.

ii) Method 'f' where heat flux sensors are used to calculate the product temperature:

$$Tb = Tshelf - \left(\left(\frac{dQ}{dt}\right)/Av\right)\Big/Kv\right) \text{ or } Tb = Ts - (HF/KV) \quad (1)$$

(a) Where Tshelf and dQ/dt are measured and Kv is a constant specific to the application.

(i) Tb=product temperature—C (ii) Tshelf—shelf surface temperature—C (iii) Kv—thermal conductivity of the vial—W/sq M C (iv) dQ/dt—Watts (v) Av—area of the vial—sq M (vi) HF—heat flux—W/SQM The following methods are examples of the different configurations that may be used. It is not meant to limit the scope of operations and is intended solely to provide examples of use.

Method 1—Center Vial Simulation Basic—Applying a thermal emulator to the outside vials and controlling the temperature of the thermal emulator, either manually or automatically, to eliminate the edge vial effect and therefore simulate center vials. During freezing the thermal emulator can simulate the conditions the outside vials may be exposed to. During primary drying lower edge vial wall temperatures will be achieved which decreases the rate of sublimation and mimics larger batches of product.

Method 2—Center Vial Simulation with Product Temperature Control—Improving upon Method 1 by additionally controlling the shelf surface temperature based on the product temperature to maintain a specified product temperature.

Method 3—Center Vial Simulation Improved—Improving upon Method 2 by measuring heat flow and other critical process parameters provides insight into the freezing and drying heat transfer dynamics. Data is used to determine the critical process parameters to develop, improve, and transfer the protocol or can be compared to similar data collected from a larger batch or larger freeze dryer. Critical process information such as; vial thermal conductivity (Kv), product temperature (Tb), and heat flow (dQ/dt) and mass flow (dM/dt) can be collected and other critical process parameters can be calculated, such as; product cake resistance (Rp).

Method 4—Center Vial Simulation Closed Loop Control—Improving upon Method 3, measuring and controlling heat flow and other critical process parameters provides closed loop control of the process for optimized process results, such as controlling the freezing process at a predetermined, programmed, or calculated heat flow rate for improved ice crystal formation. Drying, both primary and secondary, may also be controlled using heat flow that is controlled at a predetermined, programmed, or calculated heat flow.

Method 5—Center Vial Simulation Closed Loop Control with Product Temperature Control—Improving upon Method 4, additionally measuring or calculating the product temperature and controlling the shelf temperature to maintain a product temperature to a predetermined level or as close as possible to its critical temperature. This can be used to optimize the primary drying process to reduce total process times.

Method 6—Edge Vial Simulation without Thermal Contact—Simulating the edge vials can be achieved by removing the thermal conductors, which allows the user to get a better understanding of the impact of the freeze drying process under the extreme edge conditions. As an example, a 19 vial stack with a thermal emulator temperature above the shelf temperature without thermal contact will result in higher radiation and shorter drying times. The outer two rows of vials will be very similar to the edge vials in a large batch.

Method 7—Edge Vial Simulation with Thermal Contact—Simulating the edge vials with the thermal conductors in place and controlling the temperature of the conductors at higher temperatures allows the user to get a better understanding of the impact of the freeze drying process under the extreme edge conditions. As an example, a 19 vial stack with contact to a thermal emulator above the shelf temperature will result in higher vial wall temperatures and shorter drying times. The outer two rows of vials will be very similar to the edge vials in a large batch.

Traditional freeze drying process control is inefficient open loop control of the shelf temperature without feedback from product temperature and only being able to control the heat transfer fluid temperature from the point at which it flows into the shelf stack. Depending on the different product loads (i.e.: quantity, size and fill of product or vials) as well as the equipment construction (i.e.: shelf construction, fluid pump size and flow rate, etc.) the actual shelf surface temperature varies, although the inlet fluid temperature remains constant, and therefore the product temperatures across a batch can vary. In addition, the heat transfer coefficient changes with vacuum level and vial. This means that the same inlet shelf temperature may result in different product temperatures and therefore different freezing and drying results.

If thermocouples or other temperature measuring devices are placed in the vials, they can be used as feedback to control the product temperature by adjusting the shelf temperature. Typically, the product temperature would be controlled below it's critical or collapse temperature, but there are cases where the product temperature is controlled above the collapse temperature.

The thermal emulator enables different freeze drying batch conditions to be simulated, which enables a small batch of product to be used for studies and process optimization. To further improve the process, the thermal emulator can be controlled via user entered steps or the temperature can be dynamically adjusted via closed loop control based on the product temperature. The unique advantage of tracking the product temperature is that it simulates the conditions that adjacent vials would normally produce. The tracking temperature could be the same as the product temperature, vial wall temperature, or an offset can be used to simulate different operating conditions.

Figure 10:
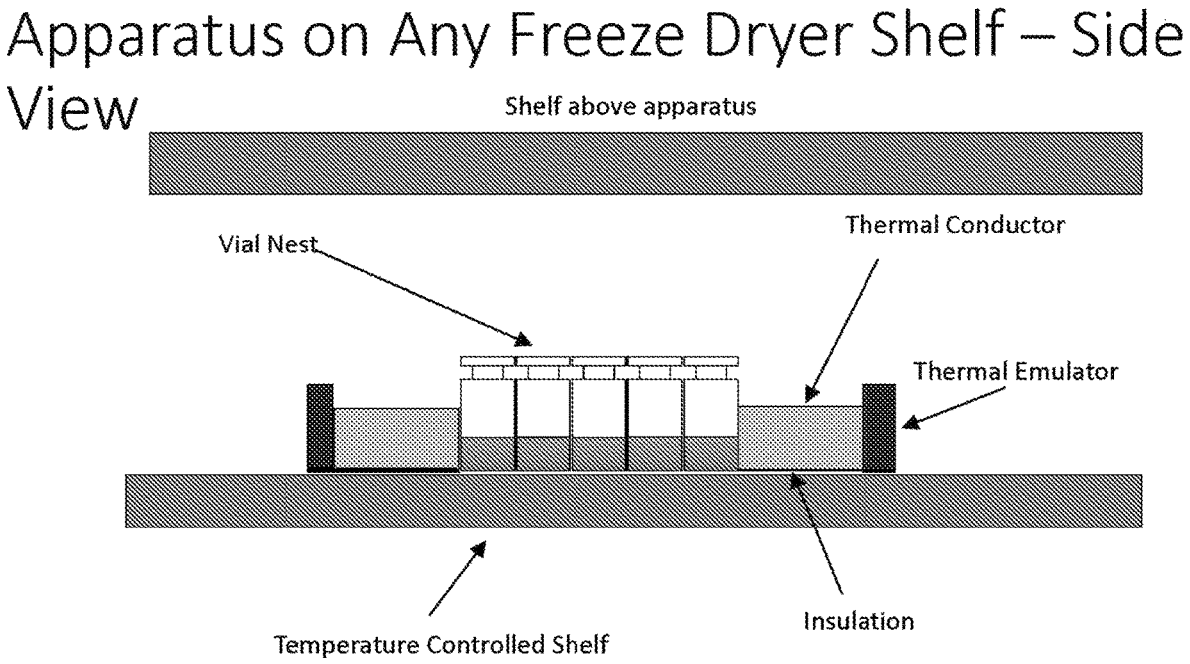
FIG. 10 is a schematic side elevational view of a thermal emulator assembly placed inside a freeze dryer.
Figure 11:
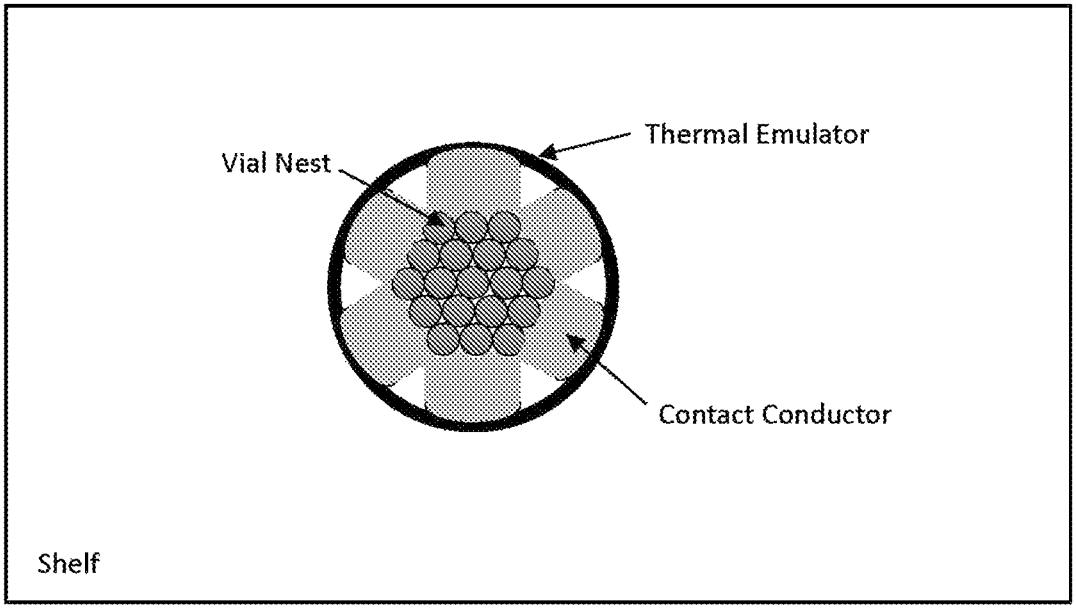
FIG. 11 is a schematic top plan view of a thermal emulator assembly placed on a shelf in a larger freeze dryer.
Figure 12:
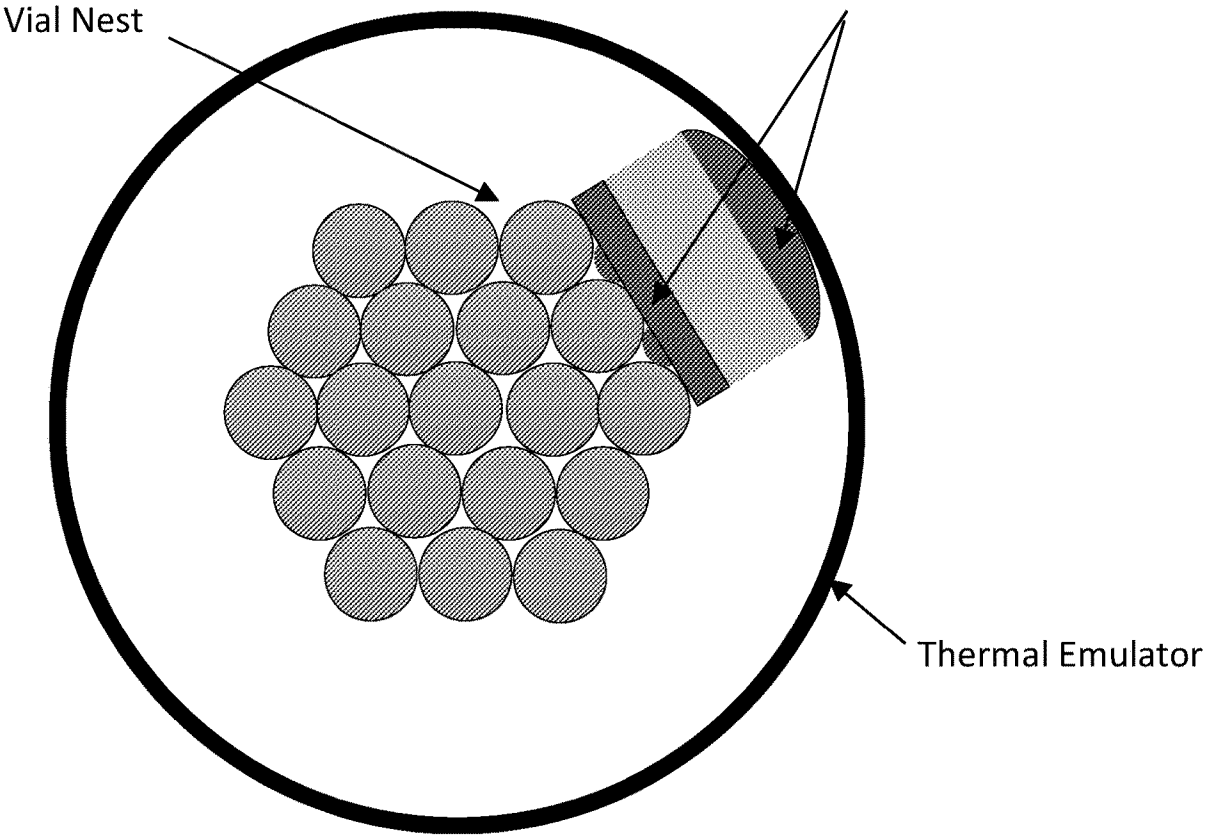
FIG. 12 is a schematic top plan view of a portion of a thermal emulator with flexible membranes for improving thermal contact with adjacent vials.

The thermal emulator apparatus can be configured to fit into any existing freeze dryer enabling protocols to be developed with small batches. The apparatus is simply placed on the shelf. This apparatus will have the same thermal control capabilities where it can control the thermal conditions of the outer vials in a nest. (FIGS. 10, 11)

The thermal emulator concept may also be used to control the edge vial thermal conditions in any freeze dryer, where a thermal emulator, such as a fluid filled tube or other heating or cooling concept, is placed in contact or close proximity to the edge vials (FIGS. 5, 6) and temperature controlled to simulate the product temperature of the center vials or any other condition.

Thermal Emulator Apparatus and Method for Process Development Using a Small Batch of Product in a Small Development Freeze Dryer An apparatus that consists of a small dedicated freeze dryer that simulates the heat transfer dynamics of larger systems using a thermal emulator on a small batch of vials. The key to an effective thermal emulation apparatus is developing a sufficient heat transfer path and a method of temperature or heat flow control to simulate the dynamics of a vial in a freeze drying process. The thermal emulator apparatus must be able to control temperature over a wide range, such as −80° C. to +105° C., while being able to change temperature rapidly to mimic the process dynamics.

Several example methods for the thermal emulation include, but are not limited to:

- Temperature controlling the freeze drying chamber walls which are
  - in intimate or close proximity to the vials
  - which use independent conductors to transfer heat to the vials
- A thermal emulator surface, such as a coil, plate, or other apparatus that is independent of the chamber wall and provides temperature or heat flow control to the vials by
  - Being in direct contact or close proximity to the vials
  - Or uses independent thermal conductors to transfer heat to vials The method for developing the necessary temperatures and heat flow can be varied and may include, but is not limited to, any combination of the following cooling and heating methods inside the temperature controlled surface:

- Cooling using
  - Flowing Liquid in a coil, plate or other configuration
  - Direct expansion of refrigerant in a coil, plate or other configuration
  - Thermoelectric device
  - LN2 or Cold Nitrogen
  - Cooled forced air
  - CO2
  - Or other cooling method
- Heating using a
  - Flowing liquid in a coil, plate, wall or other configuration
  - Resistive heating element of high or low voltage
  - Thermoelectric device(s)
  - Hot gas
  - Forced hot air
  - Or any other appropriate method The temperature controlled surface (thermal emulator) may have a single point of contact, multiple points of contact, may have intimate surface contact, or may be in close proximity to the vials.

The thermal conductors may be made out of a multitude of materials or may be made from a combination of materials, including but not limited to copper, stainless steel, ceramic, glass, conductive rubber, or any other appropriate material.

The thermal conducting surface can be made from a flexible membrane that can expand and contract to provide intimate contact with the temperature controlled surface and the vials. The flexible membrane can be filled with a thermally conductive fluid that is temperature controlled.

A method of spring loading may be used to ensure the best thermal contact between the thermal emulator, the thermal conductor and the vials.

The thermal emulator and thermal conductor can be any shape to meet the application needs. The height of the thermal emulator and thermal conductor may be varied to simulate the height of the product in the vial or any other height that is deemed appropriate for the application.

The contact between the thermal emulator and the temperature source can be enhanced using any appropriate thermally conductive material including, but not limited to, thermal paste, Chomeric rubber, encapsulated paste, encapsulated fluid, glue, epoxy, solder, or any other appropriate material. Another method of contact is the use of a flexible membrane between the temperature controlled surface and the thermal conductor block.

The temperature controlled surface may have a fixed or changeable surface that can be varied to a select emissivity from fully reflective to a black body.

The thermal emulator may also have the ability to produce temperature gradient between the top and bottom surface to simulate the temperature variation of the material being freeze dried. One example of this apparatus is adding a heater to the top surface to create a higher temperature on the top surface, simulating a temperature gradient similar to the dry product vs frozen product.

The temperature of the thermal emulator can be controlled using, but not limited to any of the following:

- A preprogrammed recipe or protocol
- Feedback of the product temperature from one or more of the vials in process
  - Thermocouple
  - Wireless temperature sensor
  - Or other temperature sensing device
- Feedback from a heat flux sensor beneath or near the vials
- Feedback of the product temperature as determined by the heat flux measurement
- Feedback of the product temperature calculated from a mass flow sensor, such as TDLAS
- Feedback from product temperature based on manometric temperature measurement
- Feedback from any other method that determines product temperature The apparatus may be further improved and enhanced by adding apparatus and methods of process monitoring and control to capture critical data and control the process. Examples of the types of instrumentation that may be added include:

- Heat flux sensors (U.S. Pat. No. 9,121,637) to determine the heat flow, product temperature and other critical process parameters. Some concepts include, but are not limited to:
  - Product temperature determination
  - Heat flow control for ice crystal growth
  - End of super-cooling
  - End of freezing
  - End of primary drying
  - End of secondary drying
  - Process analysis Heat Flux Sensor—One method of measuring heat flux is to use surface heat flux sensors that are designed to obtain a precise direct reading of thermal transfer through a surface or interface in terms of energy per unit time per unit area. A heat flux monitoring system provides data on the freeze dryer that has previously been unavailable. Either a single sensor between the shelf and vial or multiple heat flux sensors can be used. For example, the sensors can be placed between the shelf and the vial, on the radiant surface above the product, on the vial, on the walls surrounding the product, in the condensing path, etc. Multiple sensors provide more information about the overall process.

Measuring the heat flow enables monitoring and control of the ice crystal growth process. This method enables control of the shelf temperature during phase transition events when there is no product temperature change. Any suitable type of heat flux sensor may be used. As an illustrative example, a low thermal capacitance and low thermal impedance heat flux sensor is suitable for this type of application.

For the purposes of this patent application, standard freezing profiles can be used while the heat flow is monitored for use in determining any differences between the DFD and the TFD. The heat flux sensor can be implemented in various ways. For example: on the shelf surface, in the shelf surface, on the vial, and any other surface. The mounting location is not limited to the shelf for monitoring and control. It may also be mounted on the walls or other surfaces of the freeze drying apparatus that are near the vials or bulk product and may have a significant heat transfer effect on the process.

The heat flux monitoring system can operate in a standalone mode to compare any two freeze dryers or can be interfaced with the freeze dryer control system for further automation and data acquisition.

The intent of the DFD is to simulate the heat flow characteristics of larger freeze dryers. Therefore, a method to measure the target system and to control the DFD is needed. A heat flux sensor can be used to identify the proportion of heat flow to the vial, via shelf and other sources, allowing the TFD to be characterized and then simulated in the DFD. In addition, the use of heat flux sensors enables the measurement and calculations of other critical process parameters, such as: Kv, mass flow, cake resistance, etc.

The use of a heat flux monitoring system provides a method to overcome the short-comings of traditional process measurement via temperature. A heat flux monitoring system based on the heat flux measurement between shelf and product and other heat sources is the missing link for producing optimized and improved profiles.

Traditional freeze drying process control is inefficient open loop control due to limited feedback from product temperature and only being able to control the heat transfer fluid temperature from the point at which it flows into the shelf stack. Depending on the different product loads (i.e.: quantity, size and fill of product or vials) as well as the equipment construction (i.e.: shelf construction, fluid pump size and flow rate, etc.) the actual shelf surface temperature varies, although the inlet fluid temperature remains constant. In addition, the heat transfer coefficient changes with vacuum level and vial. This means that the same inlet shelf temperature may result in different product temperatures and therefore different freezing and drying results.

If thermocouples or other temperature measuring devices are placed in the vials, they can be used as feedback to control the product temperature by adjusting the shelf temperature.

Critical Process Parameters (FIG. 18)—Critical Process Parameters ("CPP" include, but are not limited to:

Shelf temperature profile—Ts

Heat flow, dQ/dt

Vial Heat Transfer Coefficient—Kv

Mass-flow, dM/dt

Sublimation front temperature

Product temperature, Tp

Product Cake Resistance, Rp

The heat flux sensor provides in-process information for Heat Flow per unit area. With this information a series of calculations can be performed to provide critical information for control of the freeze drying process. Three critical parameters can be determined, including the Vial Heat Transfer Coefficient ($K_v$), Mass Flow (dM/dt), and Product Resistance ($R_p$). The calculations enable the process parameters to be predicted instead of using the typical 'after-the-fact' open-loop control feedback of thermocouples. This makes heat flux based control a true process analytical tool. Once Kv has been determined the product temperature at the bottom of the vial ($T_b$) can be calculated, thus eliminating the need for an invasive thermocouple for monitoring product temperature Development scenarios using heat flux technology, the following methods relating to the following scenarios can be created: a freezing profile; primary drying profile; and secondary drying profile. One can also develop a baseline optimized freeze dry process profile that is robust and efficient for a DFD. The process data can be collected and stored along with the heat transfer characteristics used. To transfer the profile, the target system critical heat transfer characteristics are first identified. A conversion program can then be used to translate the baseline development cycle to a target system shelf temperature profile or heat flow profile.

The TFD can then execute the profile based on the significant process parameter, which may be either without feedback from sensors or with feedback from a heat flow monitoring system to verify proper operation.

An acceptance dead-band can be created during transfer or translation for quality control purposes. For target systems with the ability to measure heat flow in-process, adjustments can be made to compensate for changes in equipment performance or other process changes.

The Target System Heat Transfer Characteristics can be used as critical process parameters for a development system that has the heat flow measurement system integrated with the control system in a way to simulate the operation of different freeze dryers.

Another benefit from the heat flux method is limited product samples are required to finish the test run as long as they can cover the area of the sensor. Other methods like Tunable Diode Laser Absorption Spectroscopy (TDLAS) require many more samples to generate enough vapor flow for accuracy of measurement. The use of heat flux monitoring enables Quality by Design (QbD) characterization of processes and acts as a Process Analytical Technology (PAT).

Tunable laser diode system to measure mass flow

The temperature controlled conductor concept may also be used to eliminate the edge vial effect in a freeze dryer where a temperature controlled surface, such as a fluid filled tube or other heating or cooling concept, is placed in contact with or close to the edge vials.

Manometric temperature measurement may be implemented to determine the product temperature without the use of thermocouples.

Product temperature determination

End of Primary Drying

The apparatus and method of controlled nucleation can be added to the system to enable the user to test different freezing profiles and their effect on primary drying. Controlled nucleation with the ability to control freezing post-nucleation using thermal emulator enables full control of the freezing process. Any method of controlled nucleation can be used, including but not limited to the following:

- Millrock Technology's controlled nucleation of ice fog and forced ice crystals using pressurization (U.S. Pat. Nos. 8,839,528, 8,875,413)
- Other Ice fog techniques
- Other Forced ice crystals techniques
- Depressurization
- Vibration
- Any other method Process optimization can be performed by testing and improving the freezing process, primary drying process, and secondary drying process. Some, but not all of the possible methods, include:

Control of freezing process for optimum ice crystal formation and structure. Normally a simple ramp and hold are used for freezing, but this method does not produce the optimum ice crystal structure for primary and secondary drying. Using a method of controlled nucleation combined with heat flow control post-nucleation produces the most consistent and primary drying friendly structure, thus providing the foundation for efficient and robust primary drying.

During primary drying, keeping the product temperature slightly below the product critical temperature produces the shortest and most effective process. A method to dynamically adjust the shelf temperature or chamber pressure throughout the cycle can be implemented. Techniques such as the following, but not limited to these methods, may be used:

- Millrock Technology's AutoDry (U.S. Pat. No. 8,434,240) may be used to determine and control the product temperature;
- Millrock Technology's AccuFlux® and LyoPAT® technology (U.S. Pat. No. 9,121,637) may be used to determine the product temperature and provide critical process parameter information for use in improving and transferring the process to another freeze dryer;
- Manometric temperature measurement may be implemented to determine product temperature;

To improve upon the apparatus a method to control the pressure differential between the product chamber and condenser allows the user to simulate the dynamics of production sized freeze dryers. Methods for adjusting the pressure differential include but are not limited to:

- Proportional butterfly valve between product chamber and condenser
- Adjustable ball valve between the product chamber and condenser
- Iris style aperture between the product chamber and condenser
- And other methods of vacuum control that may restrict the flow between the product chamber and condenser Thermal Emulator for Process Development Using a Small Batch of Product in Any Freeze Dryer (FIGS. 10 and 11)

An apparatus and method may also be applied to laboratory and production sized freeze dryers to enable simulation of larger batches using a small amount of product, such as 1 to 37 vials.

The apparatus includes a thermal emulator assembly that is in direct contact or close proximity to the vials or uses thermal conductors that are in direct contact or close proximity to both the vial and the thermal emulator. The thermal emulator may be placed on the shelf of the freeze dryer or may be added to the system in a manner that enables proper operation.

The apparatus is added to any freeze dryer with connections either through an available port or through the front door. It may be implemented as a stand-alone system or integrated with the freeze dryer control system and mechanical systems.

The apparatus will have all the same features and capabilities of the small development freeze dryer as described previously.

Figure 13:
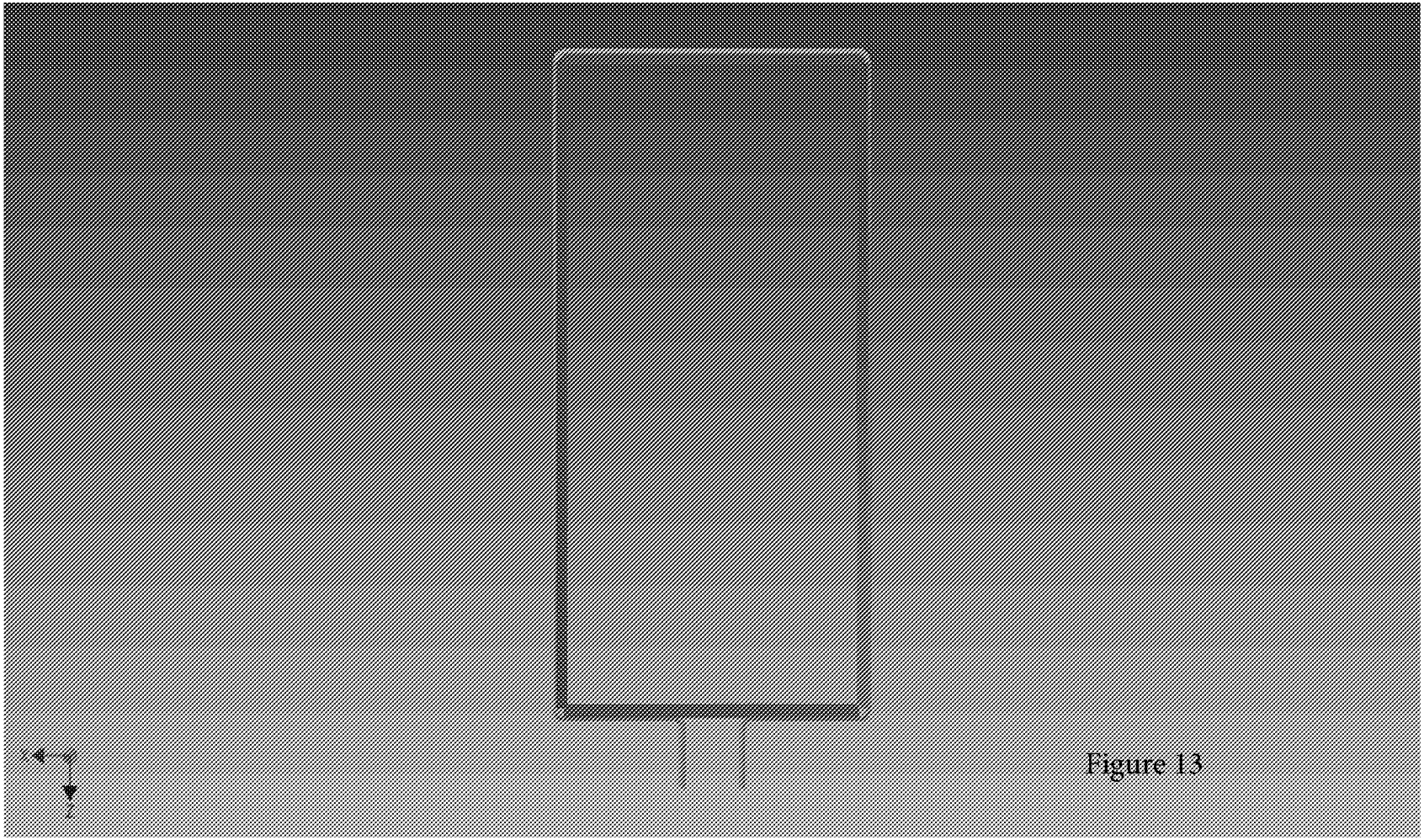
FIGS. 13 and 14 are examples of thermal emulators that may be placed in any freeze dryer to eliminate the edge vial effect.
Figure 14:
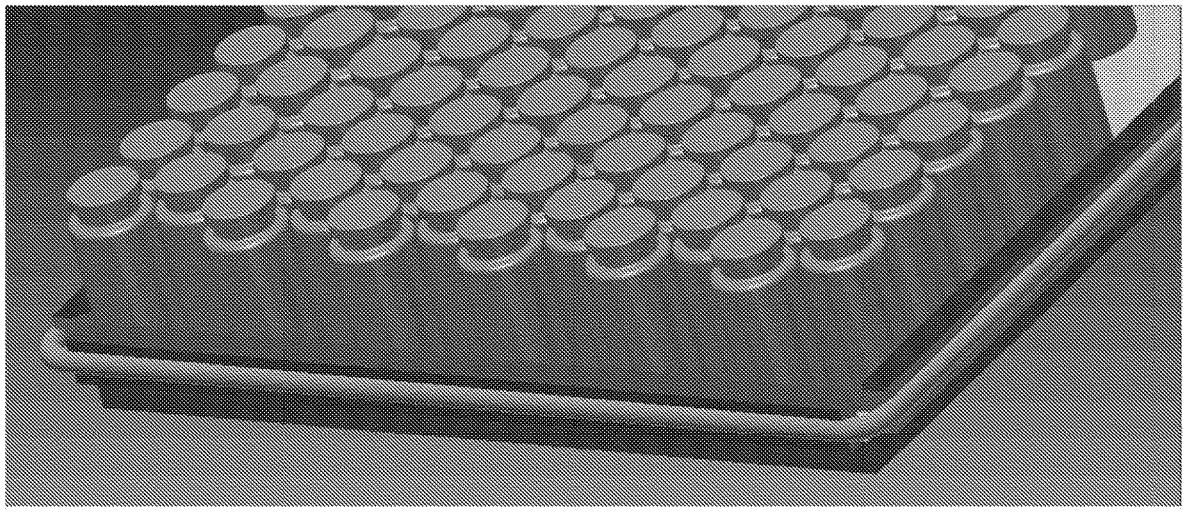
Figure 17:
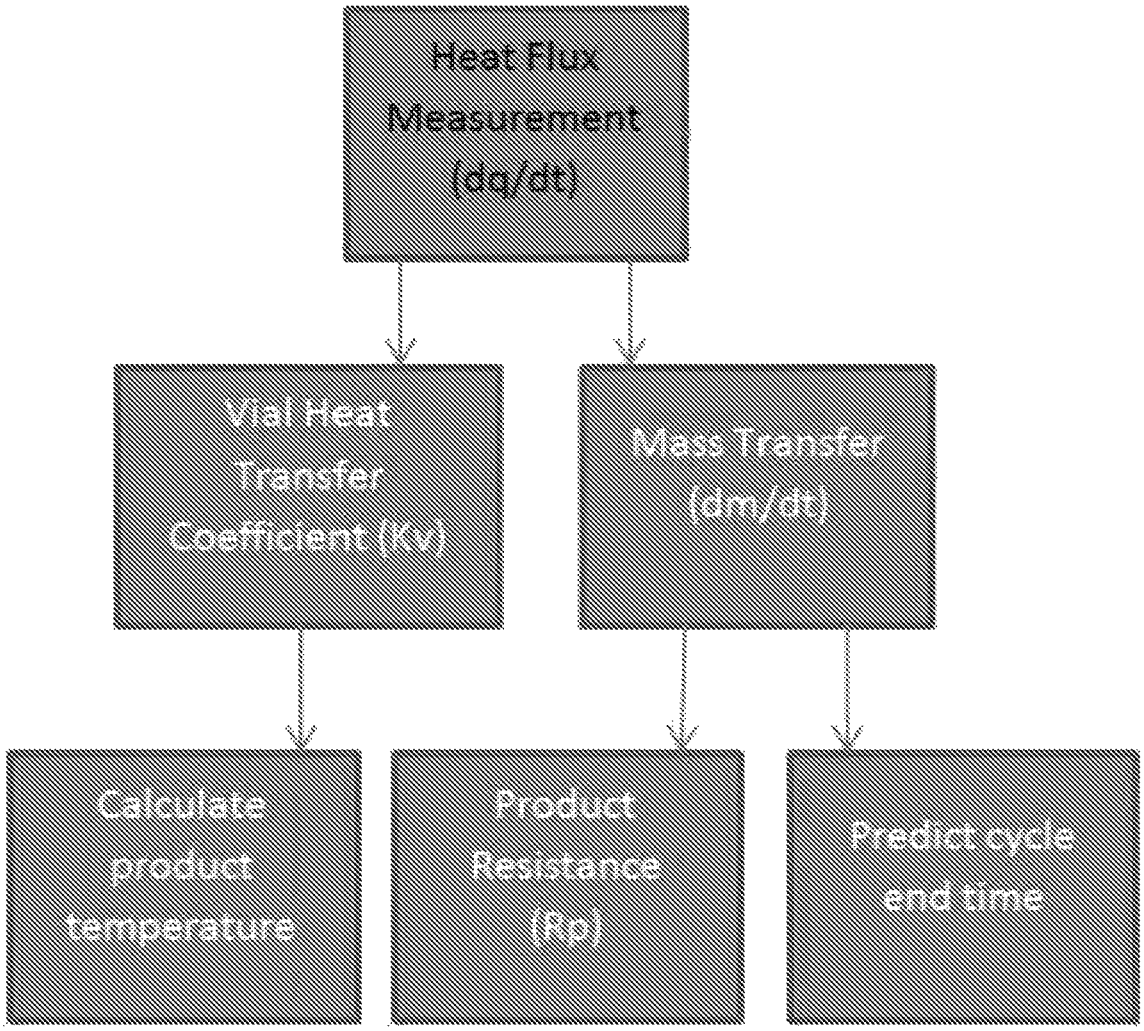
FIG. 17 is a block diagram describing how various parameters can be calculated, using the present inventive concept.

Edge Vial Elimination Apparatus for Use in Any Freeze Dryer (FIGS. 13 and 14)

An apparatus that consists of a thermal emulator that surrounds a batch of vials in a laboratory, pilot, or production freeze dryer. The thermal emulator is used to eliminate the 'edge vial' effect, where the outer 2 rows of vials typically dry faster than the center vials and therefore are processed differently. The key to an effective thermal emulation apparatus is developing a sufficient heat transfer path and a method of temperature or heat flow control to simulate the dynamics of a vial in a freeze drying process. The apparatus must be able to control temperature over a wide range, for example −80° C. to +105° C., while being able to change temperature rapidly to mimic the process.

Several example methods for the thermal emulation include, but are not limited to a thermal emulator surface, such as a chamber wall, coil, plate, or other apparatus that is independent of the chamber wall and provides temperature or heat flow control to the vials by being in direct contact or close proximity to the vials or uses independent thermal conductors to transfer heat to vials The method for developing the necessary temperatures and heat flow can be varied and may include, but is not limited to, any combination of the following cooling and heating methods inside the temperature controlled surface:

- Cooling Using
- Flowing liquid in a coil, plate, wall or other configuration
- Direct expansion of refrigerant in a coil, plate or other configuration
- Thermoelectric device
- LN2 or Cold Nitrogen
- Cooled forced air
- CO2
- Or other cooling method
- Heating using a
- Flowing liquid in a coil, plate, wall or other configuration
- Resistive heating element of high or low voltage
- Thermoelectric device(s)
- Hot gas
- Forced hot air
- Or any other appropriate method The temperature controlled surface (thermal emulator) or thermal conductor may have a single point of contact, multiple points of contact, may have intimate surface contact, or may be in close proximity to the vials.

The thermal emulator may be in direct contact to a corral or tray within which the vials or material being freeze dried are placed.

The thermal conducting surfaces may be made out of a multitude of materials or may be made from a combination of materials, including but not limited to copper, stainless steel, ceramic, glass, conductive rubber, or any other appropriate material.

The thermal emulator and thermal conductor can be any shape to meet the application needs. The height of the thermal emulator and thermal conductor may be varied to simulate the height of the product in the vial or any other height that is deemed appropriate for the application.

The contact between the thermal emulator and the temperature source can be enhanced using any appropriate thermally conductive material including, but not limited to, thermal paste, heat transfer capable rubber, encapsulated paste, encapsulated fluid, glue, epoxy, solder, or any other appropriate material.

The temperature controlled surface may have a fixed or changeable surface that can be varied to a select emissivity from fully reflective to a black body.

The thermal emulator may also have the ability to produce temperature gradient between the top and bottom surface to simulate the temperature variation of the material being freeze dried. One example of this apparatus is adding a heater to the top surface to create a higher temperature on the top surface, simulating a temperature gradient similar to the dry product vs frozen product.

The thermal emulator may be placed on the shelf of the freeze dryer or may be added to the system in a manner that enables proper operation.

The apparatus is added to any freeze dryer with connections either through an available port or through the front door. It may be implemented as a stand-alone system or integrated with the freeze dryer control system and mechanical systems.

The temperature of the thermal emulator can be controlled using, but not limited to any of the following:

- A preprogrammed recipe or protocol
- Feedback of the product temperature from one or more of the vials in process
  - Thermocouple
  - Wireless temperature sensor
  - Or any other temperature sensing device
- Feedback from a heat flux sensor beneath or near the vials
- Feedback of the product temperature determined from the heat flux measurement
- Feedback of the product temperature calculated from a mass flow sensor, such as TDLAS
- Feedback from product temperature based on manometric temperature measurement
- Feedback from any other method that determines product temperature Using a Fluid Filled Vessel to Minimize or Eliminate the Edge Vial Effect. (FIGS. 15 and 16)

A unique concept, which may be used in a limited manner, is a fluid filled vessel that surrounds the vial nest, for example 1 to 37, this is in intimate contact or close proximity to the vials. Where the vessel is filled with a fluid with similar properties to the material in the vials, so that the vessel fluid will freeze and dry in a similar fashion to the material in the vials and will simulate the heat transfer dynamics of the process and can be used in any freeze dryer.

The vessel can be made from any appropriate material such as stainless steel, aluminum, copper, plastic, glass, other metal, or other material. The vessel can be designed and built to fit the vial nest and may take any convenient external shape such as circular, hexagonal, square, or any other shape.

The vessel is placed around the vials on any freeze dryer shelf at the beginning of the process and filled with an appropriate fluid. The vessel fluid should freeze in a similar fashion and dry in a similar fashion to the vials and thus minimizes the edge vial effect. Examples of fluids including but are not limited to water, the same product that is in the vials, or a placebo.

The invention claimed is:

1. A method of monitoring and controlling a freeze drying process in a freeze drying apparatus having walls, one or more shelves and one or more vials or trays positioned on different areas of the shelves and containing a product to be freeze dried, comprising:

selecting one or more vials or trays that are representative of the positions of all of the vials or trays in different areas of the shelves, positioning one or more heat flux sensors between the selected vials or trays and adjacent portions of the walls and/or the shelves, taking measurements of heat flow between the selected vials or trays and the adjacent portions of the walls and/or the shelves during at least a part of the freeze drying process, and using information provided by the measurements of heat flow to determine one or more critical parameters, the one or more critical parameters consisting of a Vial Heat Transfer Coefficient (Kv), Mass Flow (dm/dt), and/or Product Resistance (Rp), wherein the method further comprises adjusting the Vial Heat Transfer Coefficient (Kv) of the freeze drying apparatus to stimulate a Vial Heat Transfer Coefficient (Kv) of a large freeze dryer by adjusting the temperature of a thermal conductor connected to the walls and/or the shelves.

2. The method of claim 1, wherein the one or more heat flux sensors are mounted on or embedded inside the adjacent portions of the walls and/or the shelves.

3. The method of claim 1, wherein the Vial Heat Transfer Coefficient (Kv) is determined by the following formula:

$$\frac{dq}{dt} = K_v A_v (T_s - T_b) \Rightarrow K_v = \frac{\frac{dq}{dt}}{A_v (T_s - T_b)}$$

Where:

$\frac{dq}{dt}$ = Heat transfer measured from heat flux sensor $K_v$ = Vial heat transfer coefficient to be calculated $A_v$ = Outer cross section area of vial $T_s$ = Shelf surface temperature from measurement $T_b$ = Product temperature at the bottom center of a vial.

4. The method of claim 1, further comprising calculating a product temperature at the bottom of the vials or trays based on the determined Vial Heat Transfer Coefficient (Kv).

5. The method of claim 1, wherein the Mass Flow (dm/dt) is determined by the following formula:

$$\frac{dq}{dt} = \Delta H_s \frac{dm}{dt} \Rightarrow \frac{dm}{dt} = \frac{\frac{dq}{dt}}{\Delta H_s}$$

Where:

$\frac{dq}{dt}$ = Heat transfer measured from heat flux sensor, $\Delta H_s$ = Heat of sublimination of ice, and $\frac{dm}{dt}$ = Mass transfer rate to be calculated.

6. The method of claim 1, wherein the Product Resistance (Rp) is determined by the following formula:

$$\frac{dm}{dt} = \frac{A_p(P_i - P_c)}{R_p} \Rightarrow R_p = \frac{A_p(P_i - P_c)}{\frac{dm}{dt}}$$

Wherein a vapor pressure of ice Pi is calculated by a vapor Pressure over ice equation:

$$P_i = 6.112e^{\left(\frac{22.46T_b}{272.62+T_b}\right)}$$

Where:

$\frac{dm}{dt}$ = a mass transfer rate to be calculated $A_p$ = an inner cross section area of vial $P_i$ = the vapor pressure of ice calculated from ice temperature $T_b$ $P_c$ = a chamber pressure $R_p$ = a resistance of a dried product layer to be calculated $T_b$ = a product temperature at the bottom center of a vial.

7. The method of claim 1, further comprising:

using data provided by the measurements of heat flow and/or the determined one or more critical parameters to develop a freezing and/or drying protocol transferrable from the freeze drying apparatus to another freeze drying apparatus.

8. The method of claim 7, wherein the freeze drying apparatus is a lab freeze dryer, and said another freeze drying apparatus is a production freeze dryer.

9. The method of claim 1, further comprising simulating an operation of a production freeze dryer based on data provided by the measurements of heat flow and/or the determined one or more critical parameters, wherein the freeze drying apparatus is a lab freeze dryer.

10. The method of claim 1, further comprising adjusting the Vial Heat Transfer Coefficient (Kv) of the freeze drying apparatus to simulate the Vial Heat Transfer Coefficient (Kv) of the large freeze dryer by adjusting a shelf temperature of the freeze drying apparatus.

11. The method of claim 1, wherein the measurements of heat flow are taken between the selected vials or trays and the adjacent portions of the walls and/or the shelves during the entire freeze drying process.

12. The method of claim 1, wherein the measurements of heat flow are taken between the selected vials or trays and the adjacent portions of the walls and/or the shelves during a freezing stage of the freeze drying process.

13. The method of claim 12, further comprising using information provided by the measurements of heat flow to determine the end of the freezing stage.

14. The method of claim 12, further comprising controlling nucleation by controlling the heat flow between the selected vials or trays and the adjacent portions of the walls and/or the shelves during the freezing stage to produce a consistent crystal structure across an entire batch of vials or trays and/or inside each of the vials or trays.

15. The method of claim 12, further comprising controlling the heat flow between the selected vials or trays and the adjacent portions of the walls and/or the shelves during the freezing stage.

16. The method of claim 1, wherein the measurements of heat flow are taken between the selected vials or trays and the adjacent portions of the walls and/or the shelves during a primary drying stage of the freeze drying process.

17. The method of claim 16, further comprising using information provided by the measurements of heat flow to determine the end of the primary drying stage.

18. The method of claim 16, further comprising monitoring the primary drying stage based on information provided by the measurements of heat flow to ensure a primary drying process to be completed properly and consistently.

19. The method of claim 16, further comprising using information provided by the measurements of heat flow to control a shelf temperature to maintain a product temperature to a predetermined level or as close as possible to its critical temperature during the primary drying stage.

20. The method of claim 16, further comprising using information provided by the measurements of heat flow to define and plot a cycle optimization design space, wherein, based on the cycle optimization design space, an optimum shelf temperature and/or an optimum chamber pressure is selected for use in a laboratory or production freeze drying apparatus.

21. The method of claim 1, wherein the measurements of heat flow are taken between the selected vials or trays and the adjacent portions of the walls and/or the shelves during a secondary drying stage of the freeze drying process.

22. The method of claim 21, further comprising using information provided by the measurements of heat flow to determine the end of the secondary drying stage.

23. The method of claim 21, further comprising using information provided by the measurements of heat flow to monitor and/or control the secondary drying stage.

24. A method of monitoring and controlling a freeze process in a freeze drying apparatus having walls, one or more shelves and one or more vials or trays positioned on different areas of the shelves and containing a product to be freeze dried, comprising:

selecting one or more vials or trays that are representative of the positions of all of the vials or trays in different areas of the shelves, positioning one or more heat flux sensors between the selected vials or trays and adjacent positions of the walls and/or the shelves, and taking measurements of heat flow between the selected vials or trays and the adjacent positions of the walls and/or the shelves during at least a part of the freeze drying process, wherein the one or more heat flux sensors are mounted on top or bottom surfaces of the adjacent portions of the shelves, and one or more stainless foils are positioned between the one or more heat flux sensors and the vials or trays.

* * * * *